US008562319B2

(12) United States Patent
Matsumoto et al.

(10) Patent No.: US 8,562,319 B2
(45) Date of Patent: Oct. 22, 2013

(54) SCREW COMPRESSOR HAVING SLIDE VALVE WITH INCLINED END FACE

(75) Inventors: Norio Matsumoto, Sakai (JP); Nozomi Gotou, Sakai (JP); Shigeharu Shikano, Sakai (JP); Hideyuki Gotou, Sakai (JP); Harunori Miyamura, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 53 days.

(21) Appl. No.: 13/378,259

(22) PCT Filed: Jun. 4, 2010

(86) PCT No.: PCT/JP2010/003763

§ 371 (c)(1),
(2), (4) Date: Dec. 14, 2011

(87) PCT Pub. No.: WO2010/146793

PCT Pub. Date: Dec. 23, 2010

(65) Prior Publication Data

US 2012/0100028 A1 Apr. 26, 2012

(30) Foreign Application Priority Data

Jun. 15, 2009 (JP) ..... 2009-142659

(51) Int. Cl.
*F03C 4/00* (2006.01)
*F04C 2/00* (2006.01)
*F04C 18/00* (2006.01)

(52) U.S. Cl.
USPC ..... 418/195; 418/201.1; 418/202.2

(58) Field of Classification Search
USPC ..... 418/201.1–201.2, 195
See application file for complete search history.

(56) References Cited

U.S. PATENT DOCUMENTS

| | | | | |
|---|---|---|---|---|
| 4,534,719 | A | 8/1985 | Zimmern | |
| 4,610,612 | A * | 9/1986 | Kocher | 418/195 |
| 2010/0260620 | A1 * | 10/2010 | Miyamura et al. | 417/213 |

FOREIGN PATENT DOCUMENTS

| | | | |
|---|---|---|---|
| JP | 43-21004 | | 9/1968 |
| JP | 58-169187 | U | 11/1983 |
| JP | 59-32689 | A | 2/1984 |
| JP | 6-42474 | A | 2/1994 |
| JP | 2004-316586 | A | 11/2004 |

OTHER PUBLICATIONS

International Search Report of corresponding PCT Application No. PCT/JP2010/003763, mailing date on Jul. 9.

* cited by examiner

*Primary Examiner* — Theresa Trieu
(74) *Attorney, Agent, or Firm* — Global IP Counselors

(57) ABSTRACT

A screw compressor includes a screw rotor, a casing, a low pressure space, a bypass passage and a slide valve. The screw rotor is provided with a plurality of helical grooves forming fluid chambers. The casing includes a cylinder portion with the screw rotor disposed in the cylinder portion. The low pressure space is formed in the casing to receive a flow of uncompressed, low pressure fluid. The bypass passage is opened in an inner peripheral surface of the cylinder portion to communicate the fluid chamber with the low pressure space. The slide valve is slideable in an axial direction of the screw rotor to change an area of an opening of the bypass passage in the inner peripheral surface of the cylinder portion. An end face of the slide valve facing the bypass passage is inclined along an extending direction of the helical grooves.

4 Claims, 19 Drawing Sheets

(A)

(B)

(a)

(b)

(c)

(d)

(e)

(f)

SCREW COMPRESSOR HAVING SLIDE VALVE WITH INCLINED END FACE

CROSS-REFERENCE TO RELATED APPLICATIONS

This U.S. National stage application claims priority under 35 U.S.C. §119(a) to Japanese Patent Application No. 2009-142659, tiled in Japan on Jun. 15, 2009, the entire contents of which are hereby incorporated herein by reference.

TECHNICAL FIELD

The present invention relates to measures to improve performance of screw compressors.

BACKGROUND ART

Screw compressors have been used as compressors for compressing a refrigerant or air. For example, Japanese Patent Publication Nos. 2004-316586 and H06-042474 disclose a single screw compressor including a single screw rotor and two gate rotors.

The single screw compressor will be described below. The screw rotor is substantially in the shape of a round column, and a plurality of helical grooves are formed in an outer peripheral surface thereof. Each of the gate rotors is substantially in the shape of a flat plate, and is arranged laterally adjacent to the screw rotor. The gate rotor includes a plurality of rectangular plate-shaped gates which are radially arranged. The gate rotor is arranged with an axis of rotation thereof perpendicular to an axis of rotation of the screw rotor, and the gates mesh with the helical grooves of the screw rotor.

The screw rotor and the gate rotors of the single screw compressor are contained in a casing. Fluid chambers are formed by the helical grooves of the screw rotor, the gates of the gate rotor, and an inner wall surface of the casing. When the screw rotor is rotated by an electric motor etc., the gate rotors are rotated by the rotation of the screw rotor. The gates of the gate rotors move relatively from start ends (ends through which a fluid is sucked) to terminal ends (ends through which the fluid is discharged) of the meshed helical grooves, thereby gradually reducing a volume of the fluid chamber which is completely closed. In this way, the fluid in the fluid chamber is compressed.

As disclosed by Japanese Patent Publication Nos. 2004-316586 and H06-042474, the screw compressor includes a slide valve for controlling a capacity. The slide valve is arranged to face an outer peripheral surface of the screw rotor, and is slidable in a direction parallel to the axis of rotation of the screw rotor. The screw compressor includes a bypass passage for communicating the fluid chamber in a compression stroke with a suction side of the compressor. When the slide valve moves, an area of an opening of the bypass passage in an inner peripheral surface of a cylinder in which the screw rotor is inserted varies, and a flow rate of fluid returned to low pressure space through the bypass passage varies. As a result, a flow rate of fluid which is finally compressed in the fluid chamber and discharged therefrom varies, and a flow rate of fluid discharged from the screw compressor (i.e., an operating capacity of the screw compressor) varies.

SUMMARY

Technical Problem

In the conventional screw compressor described above, the slide valve is moved to change the area of the opening of the bypass passage, and the flow rate of the fluid flowing from the fluid chamber to the bypass passage, thereby controlling the operating capacity of the screw compressor. According to the conventional screw compressor, however, the shape of the opening of the bypass passage formed in the inner peripheral surface of the cylinder is not appropriate, and pressure loss which occurs when the fluid flows from the fluid chamber to the bypass passage is increased. This may increase power required to drive the screw rotor.

The disadvantage of the conventional screw compressor will be described in detail below with reference to FIGS. 21 and 22. FIG. 21 shows a development of a screw rotor (540), on which a gate rotor (550) and a slide valve (570) are shown. FIG. 22 shows a development of the screw rotor (540), on which only the gate rotor (550) and an opening (534) of a bypass passage (533) are shown.

As shown in FIG. 21, an outer peripheral surface of the screw rotor (540) is covered with a cylinder (530) of a casing. In this figure, space above the screw rotor (540) constitutes low pressure space in the casing, and space below the screw rotor (540) constitutes high pressure space in the casing. Gates of the gate rotor (550) mesh with helical grooves (541) of the screw rotor (540), and the slide valve (570) is arranged laterally adjacent to the gate rotor (550). The slide valve (570) is able to reciprocate in a direction parallel to an axis of rotation of the screw rotor (540) (i.e., a direction perpendicular to a rotating direction of the screw rotor (540)).

An end face (602) of the slide valve (570) is a flat face perpendicular to a moving direction of the slide valve (570). A seat surface (601) of the cylinder (530) facing the end face (602) of the slide valve (570) is also a flat face perpendicular to the moving direction of the slide valve (570). Part of an inner peripheral surface of the cylinder (530) sandwiched between the end face (602) of the slide valve (570) and the seat surface (601) of the cylinder (530) is an opening (534) of a bypass passage (533). When a development of the opening (534) of the bypass passage (533) in the inner peripheral surface of the cylinder (530) is shown on a development of the screw rotor (540), the opening (534) is in the shape of a rectangle having a long side parallel to the rotating direction of the screw rotor (540) as shown in FIG. 22.

FIG. 22 shows how a positional relationship among one of the openings (534) of the bypass passages (533), one of the gate rotors (550), and the helical groove (541) of the screw rotor (540) changes. Referring to the helical groove (541) depicted with a thick line, how the positional relationship among the three parts changes will be described below.

FIG. 22(*a*) shows that the opening (534) of the bypass passage (533) is about to communicate with a fluid chamber (523) formed by the helical groove (541). When the screw rotor (540) is rotated in this state, the opening (534) of the bypass passage (533) starts to communicate with the fluid chamber (523). In an early stage of a period in which the fluid chamber (523) communicates with the bypass passage (533), a pressure of fluid in the fluid chamber (523) is approximately the same as a pressure of fluid in the low pressure space. Then, in the state of FIG. 22(*c*) after passing through the state of FIG. 22(*b*), the fluid chamber (523) formed by the helical groove (541) is divided from the low pressure space by the gate of the gate rotor (550). The fluid chamber (523) divided from the low pressure space by the gate rotor (550) keeps communicating with the bypass passage (533) in the states of FIGS. 22(*d*) and 22(*e*) until immediately before the state of FIG. 22(*f*), and part of the fluid flowed from the low pressure space to the fluid chamber (523) is pushed into the bypass passage (533) during the period. In the state of FIG. 22(*f*), the fluid chamber (523) is blocked from the bypass passage (533), and becomes closed space. When the screw rotor (540) is further rotated in the state of FIG. 22(*f*), the fluid in the fluid chamber (523) is compressed.

As described above, in a period from the state of FIG. 22(*c*) until immediately before the state of FIG. 22(*f*), the fluid in the fluid chamber (523) is pushed into the bypass passage (533) by the gate. When significant pressure loss occurs when the fluid flows from the fluid chamber (523) to the bypass passage (533) in this period, power required to push the fluid into the bypass passage (533) by the gate is increased, thereby reducing the operating efficiency.

In a period from the state of FIG. 22(*c*) until immediately before the state of FIG. 22(*f*), only part of the opening (534) of the bypass passage (533) overlaps the helical groove (541), and the fluid in the fluid chamber (523) formed by the helical groove (541) flows into the bypass passage (533) only through the part of the opening (534) of the bypass passage (533) overlapping the helical groove (541). Thus, in this period, an area of the opening (534) of the bypass passage (533) through which the fluid flowing out of the fluid chamber (523) passes is insufficient, and the pressure loss which occurs when the fluid flows from the fluid chamber (523) to the bypass passage (533) is increased. Thus, in the conventional screw compressor, the power required to push the fluid into the bypass passage (533) by the gate is increased. Even when the operating capacity of the screw compressor is set low, the power for driving the screw rotor (540) cannot be reduced sufficiently.

In particular, in the conventional screw compressor, the area of the opening (534) of the bypass passage (533) overlapping the helical groove (541) is abruptly reduced in a last stage of the period in which the fluid chamber (523) communicates with the bypass passage (533). Thus, reduction in operating efficiency has been severe when the operating capacity of the screw compressor is low.

In view of the foregoing, the present invention has been achieved. The present invention is concerned with improving the operating efficiency of a screw compressor including a slide valve for controlling the operating capacity when the operating capacity is set low.

Solution to the Problem

A first aspect of the invention is directed to a screw compressor including: a screw rotor (40) provided with a plurality of helical grooves (41) constituting fluid chambers (23); a casing (10) including a cylinder portion (30) in which the screw rotor (40) is inserted; low pressure space (S1) which is formed in the casing (10), and in which uncompressed, low pressure fluid flows; a bypass passage (33) which is opened in an inner peripheral surface (35) of the cylinder portion (30) to communicate the fluid chamber (23) with the low pressure space (S1); and a slide valve (70) which slides in an axial direction of the screw rotor (40) to change an area of an opening of the bypass passage (33) in the inner peripheral surface (35) of the cylinder portion (30). An end face (P2) of the slide valve (70) facing the bypass passage (33) is inclined along an extending direction of the helical grooves (41).

In the screw compressor (1) of the first aspect of the invention, the screw rotor (40) is inserted in the cylinder portion (30) of the casing (10). When the screw rotor (40) is rotated, the fluid is sucked into the fluid chamber (23) formed by the helical groove (41), and is compressed therein. When the slide valve (70) of the screw compressor (1) slides, the area of the opening of the bypass passage (33) in the inner peripheral surface (35) of the cylinder portion (30) is changed, and a flow rate of the fluid flowing from the fluid chamber (23) to the low pressure space (S1) through the bypass passage (33) is changed. Specifically, when the slide valve (70) slides, the amount of the fluid discharged from the screw compressor (1) per unit time (i.e., the operating capacity of the screw compressor (1)) is changed.

In the slide valve (70) according to the first aspect of the invention, the end face (P2) faces the bypass passage (33), and the end face (P2) is inclined along the extending direction of the helical grooves (41) formed in the screw rotor (40). Thus, the opening (34) of the bypass passage (33) in the inner peripheral surface (35) of the cylinder portion (30) is inclined along the extending direction of the helical grooves (41) formed in the screw rotor (40). This can increase the area of the opening (34) of the bypass passage (33) overlapping the helical groove (41), thereby reducing pressure loss which occurs when the fluid in the fluid chamber (23) flows into the bypass passage (33).

According to a second aspect of the invention related to the first aspect of the invention, part of an outer peripheral surface (49) of the screw rotor (40) sandwiched between two adjacent helical grooves (41) constitutes a circumferential sealing face (45) which slides on the inner peripheral surface (35) of the cylinder portion (30) to seal between the two adjacent helical grooves (41), an edge of the circumferential sealing face (45) positioned forward in a direction of rotation of the screw rotor (40) constitutes a front edge (46) of the circumferential sealing face (45), an edge of the end face (P2) of the slide valve (70) adjacent to the screw rotor (40) constitutes a screw-side edge (73), and the screw-side edge (73) of the slide valve (70) is parallel to the front edge (46) of the circumferential sealing face (45) of the screw rotor (40).

In the second aspect of the invention, the screw-side edge (73) of the slide valve (70) is parallel to the front edge (46) of the circumferential sealing face (45) of the screw rotor (40). Thus, while the screw rotor (40) is rotated, the screw-side edge (73) of the slide valve (70) does not intersect with the front edge (46) of the circumferential sealing face (45) of the screw rotor (40), and every part of the screw-side edge (73) of the slide valve (70) coincides with the front edge (46) of the circumferential sealing face (45) of the screw rotor (40) at the moment when the fluid chamber (23) is blocked from the bypass passage (33). Specifically, every part of the screw-side edge (73) of the slide valve (70) is exposed in the fluid chamber (23) until the fluid chamber (23) is blocked from the bypass passage (33).

According to a third aspect of the invention related to the first aspect of the invention, part of an outer peripheral surface (49) of the screw rotor (40) sandwiched between two adjacent helical grooves (41) constitutes a circumferential sealing face (45) which slides on the inner peripheral surface (35) of the cylinder portion (30) to seal between the two adjacent helical grooves (41), an edge of the end face (P2) of the slide valve (70) adjacent to the screw rotor (40) constitutes a screw-side edge (73), and the screw-side edge (73) of the slide valve (70) is shaped in such a manner that every part thereof is able to simultaneously overlap the circumferential sealing face (45).

In the third aspect of the invention, the screw-side edge (73) of the slide valve (70) is inclined along the helical groove (41) of the screw rotor (40), and every part thereof is able to simultaneously overlap the circumferential sealing face (45) of the screw rotor (40). Specifically, every part of the screw-side edge (73) of the slide valve (70) overlaps the circumferential sealing face (45) when the fluid chamber (23) is blocked from the bypass passage (33).

According to a fourth aspect of the invention related to any one of the first to third aspects of the invention, the screw compressor further includes: a gate rotor (50) including a plurality of radially arranged gates (51) which mesh with the helical grooves (41) of the screw rotor (40), wherein an opening (34) of the bypass passage (33) formed in the inner peripheral surface (35) of the cylinder portion (30) is fully opened in the fluid chamber (23) divided from the low pressure space (S1) by the gate (51) in a period in which the screw rotor (40) is rotated by a predetermined angle.

In the fourth aspect of the invention, the gate (51) of the gate rotor (50) meshes with the helical groove (41) of the screw rotor (40). In this invention, the end face (P2) of the slide valve (70) is inclined along the extending direction of the helical groove (41) of the screw rotor (40), and the opening (34) of the bypass passage (33) formed in the inner peripheral surface (35) of the cylinder portion (30) is fully opened in the fluid chamber (23) divided from the low pressure space (S1) by the gate (51) in the predetermined period. In this period, the fluid in the fluid chamber (23) flows into the bypass passage (33) through the fully opened opening (34) of the bypass passage (33) in the inner peripheral surface (35) of the cylinder portion (30).

Advantages of the Invention

In the present invention, the end face (P2) of the slide valve (70) is inclined along the extending direction of the helical groove (41) formed in the screw rotor (40), and the opening (34) of the bypass passage (33) in the inner peripheral surface (35) of the cylinder portion (30) is also inclined along the extending direction of the helical groove (41) formed in the screw rotor (40). Thus, the area of the opening (34) of the bypass passage (33) in the inner peripheral surface (35) of the cylinder portion (30) overlapping the helical groove (41) can be increased, and the pressure loss which occurs when the fluid in the fluid chamber (23) flows into the bypass passage (33) can be reduced. Thus, the present invention can reduce power required to push the fluid in the fluid chamber (23) into the bypass passage (33), and can improve the operating efficiency of the screw compressor (1) when the bypass passage (33) is opened in the inner peripheral surface (35) of the cylinder portion (30) (i.e., when the operating capacity of the screw compressor (1) is set to be lower than the maximum capacity).

In the second aspect of the invention, the screw-side edge (73) of the slide valve (70) is parallel to the front edge (46) of the circumferential sealing face (45) of the screw rotor (40). Thus, every part of the screw-side edge (73) of the slide valve (70) is exposed in the fluid chamber (23) until the fluid chamber (23) is blocked from the bypass passage (33). Thus, the present invention can increase the area of the opening (34) of the bypass passage (33) in the inner peripheral surface (35) of the cylinder portion (30) overlapping the helical groove (41) as much as possible until the fluid chamber (23) is blocked from the bypass passage (33), and can reliably reduce the power required to push the fluid in the fluid chamber (23) into the bypass passage (33).

In the third aspect of the invention, the screw-side edge (73) of the slide valve (70) is inclined along the extending direction of the helical groove (41) formed in the screw rotor (40), and every part thereof is able to simultaneously overlap the circumferential sealing face (45) of the screw rotor (40). Thus, the present invention can ensure a sufficient area of the opening (34) of the bypass passage (33) in the inner peripheral surface (35) of the cylinder portion (30) overlapping the helical groove (41).

In the fourth aspect of the invention, the opening (34) of the bypass passage (33) in the inner peripheral surface (35) of the cylinder portion (30) is temporarily fully opened in the fluid chamber (23) divided from the low pressure space (S1) by the gate (51). Thus, in a period in which the fluid in the fluid chamber (23) is pushed into the bypass passage (33) by the gate (51), the area of the opening (34) of the bypass passage (33) in the inner peripheral surface (35) of the cylinder portion (30) overlapping the helical groove (41) can be maximized, and the power required to push the fluid in the fluid chamber (23) into the bypass passage (33) can reliably be reduced.

BRIEF DESCRIPTION OF THE DRAWINGS

FIG. 1 is a vertical cross-sectional view illustrating a major part of a single screw compressor.

FIG. 2 is a lateral cross-sectional view taken along the line A-A of FIG. 1.

FIG. 3 is a perspective view illustrating a major part of the single screw compressor.

FIG. 4 is a perspective view of a screw rotor.

FIG. 5 is a perspective view of a slide valve.

FIG. 6 is a front view of the slide valve.

FIG. 7 is a development of the screw rotor illustrated with a cylinder portion, a slide valve, and a gate rotor.

FIGS. 8(A) to 8(C) are plan views illustrating operation of a compression mechanism of the single screw compressor, FIG. 8(A) shows a suction phase, FIG. 8(B) shows a compression phase, and FIG. 8(C) shows a discharge phase.

FIG. 10 is an enlargement of FIG. 9(*b*).

FIGS. 11(A) and 11(B) are developments of the screw rotor illustrated with the opening of the bypass passage and the gate rotor, FIG. 11(A) is an enlargement of FIG. 9(*d*), and FIG. 11(B) is an enlargement of FIG. 9(*e*).

FIG. 12 is an enlargement of FIG. 9(*f*).

FIG. 13 is a graph illustrating a relationship between a rotation angle of the screw rotor and an actual bypass area.

FIG. 14 is a graph illustrating a relationship between a rotation angle of the screw rotor and a pressure of a refrigerant in a fluid chamber.

FIGS. 15(A) and 15(B) are developments of a screw rotor according to a first alternative of an embodiment, FIG. 15(A) corresponds to FIG. 7, and FIG. 15(B) corresponds to FIG. 12.

FIG. 16 is a development of the screw rotor according to the first alternative of the embodiment, illustrating a state immediately before the fluid chamber is blocked from the bypass passage.

FIGS. 17(A) and 17(B) are developments of a screw rotor according to a second alternative of the embodiment, FIG. 17(A) corresponds to FIG. 7, and FIG. 17(B) corresponds to FIG. 12.

FIGS. 18(A) and 18(B) are developments of the screw rotor according to the second alternative of the embodiment, FIG. 18(A) corresponds to FIG. 7, and FIG. 17(B) corresponds to FIG. 12.

FIGS. 19(A) and 19(B) are developments of a screw rotor according to a third alternative of the embodiment, FIG. 19(A) corresponds to FIG. 7, and FIG. 19(B) corresponds to FIG. 12.

FIGS. 20(A) and 20(B) are developments of the screw rotor according to the third alternative of the embodiment, FIG. 20(A) corresponds to FIG. 7, and FIG. 20(B) corresponds to FIG. 12.

FIG. 21 is a view corresponding to FIG. 7 illustrating a conventional single screw compressor.

FIG. 22 is a view corresponding to FIG. 9 illustrating the conventional single screw compressor.

DESCRIPTION OF EMBODIMENTS

An embodiment of the present invention will be described in detail with reference to the drawings. A single screw compressor (1) of the present embodiment (hereinafter merely referred to as a screw compressor) is provided in a refrigerant circuit for performing a refrigeration cycle, and compresses a refrigerant.

Figure 1:
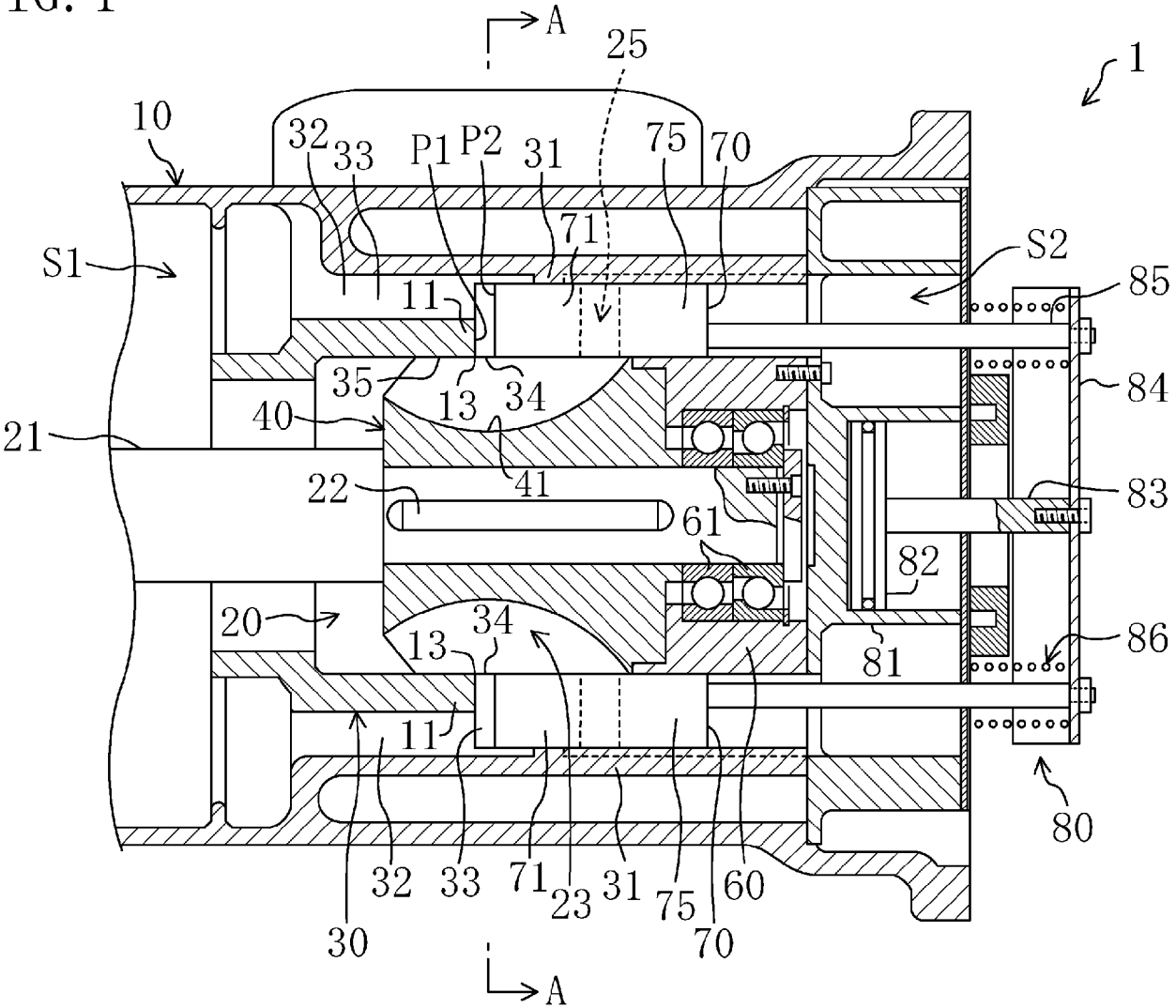
[FIG. 1]
Figure 2:
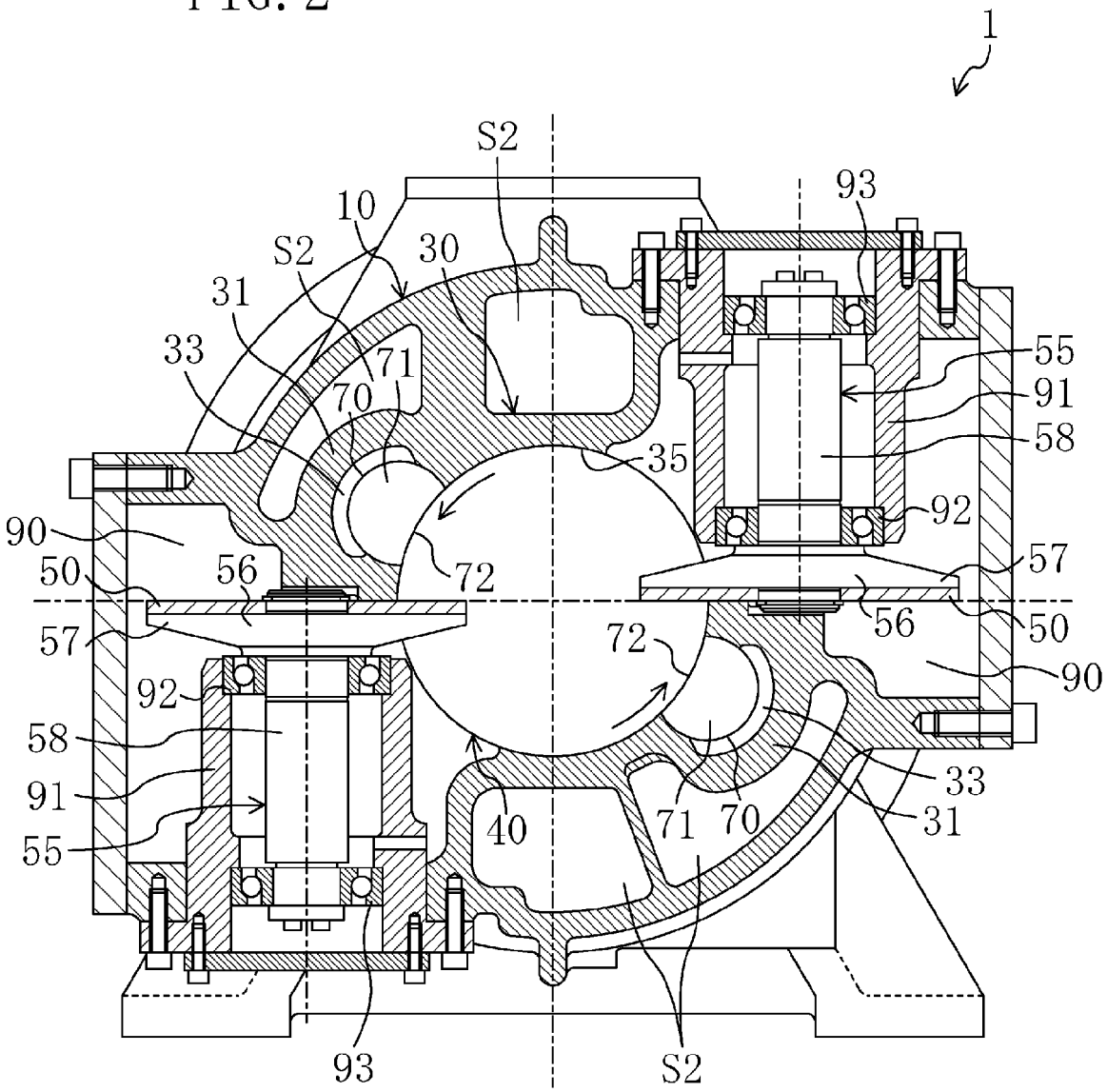
[FIG. 2]

As shown in FIGS. 1 and 2, the screw compressor (1) is semi-hermetic. In this screw compressor (1), a compression mechanism (20) and an electric motor for driving the compression mechanism are contained in a metallic casing (10). The compression mechanism (20) is coupled to the electric motor through a drive shaft (21). The electric motor is not shown in FIG. 1. Space inside the casing (10) is divided into low pressure space (S1) to which a low pressure gaseous refrigerant is introduced from an evaporator of the refrigerant circuit, and from which the low pressure gaseous refrigerant is guided to the compression mechanism (20), and high pressure space (S2) in which a high pressure gaseous refrigerant discharged from the compression mechanism (20) flows.

The compression mechanism (20) includes a cylindrical wall (30) formed in the casing (10), a screw rotor (40) inserted in the cylindrical wall (30), and two gate rotors (50) which mesh with the screw rotor (40).

The cylindrical wall (30) is substantially cylindrical, and is provided to cover an outer peripheral surface (49) of the screw rotor (40). The cylindrical wall (30) constitutes a divider wall. The cylindrical wall (30) is partially cut away to form an inlet (36).

The drive shaft (21) is inserted in the screw rotor (40). The screw rotor (40) and the drive shaft (21) are coupled through a key (22). The drive shaft (21) is arranged coaxially with the screw rotor (40). A tip end of the drive shaft (21) is rotatably supported by a bearing holder (60) provided on a high pressure side of the compression mechanism (20) (on the right side of the compression mechanism provided that an axial direction of the drive shaft (21) in FIG. 1 is a right-left direction). The bearing holder (60) supports the drive shaft (21) through ball bearings (61).

Figure 3:
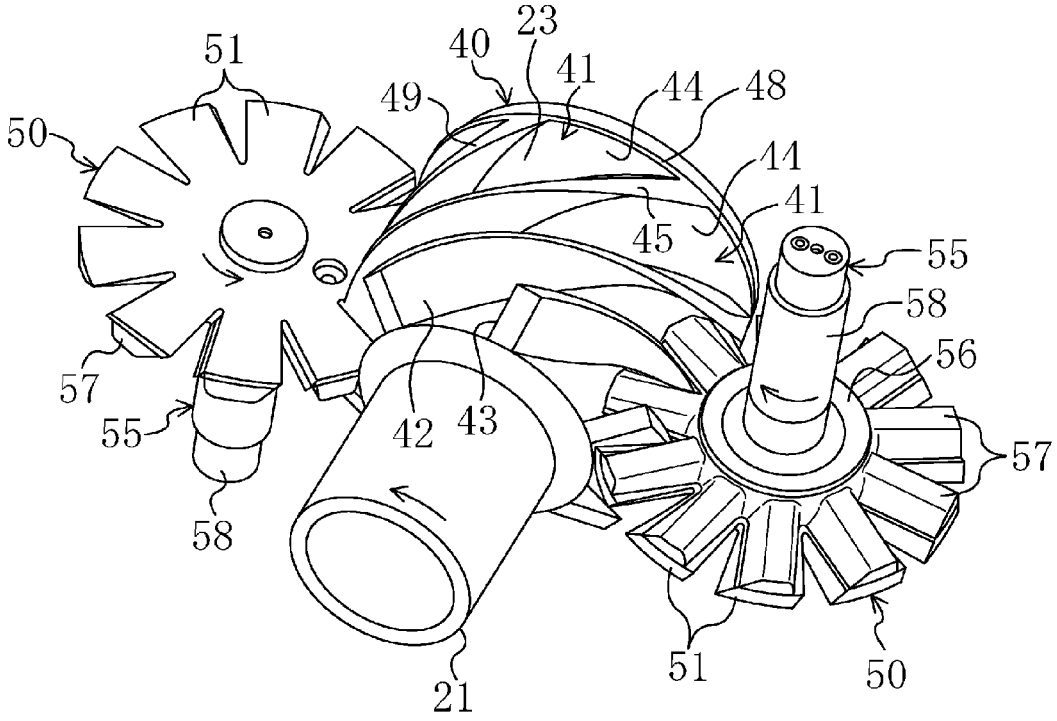
[FIG. 3]
Figure 4:
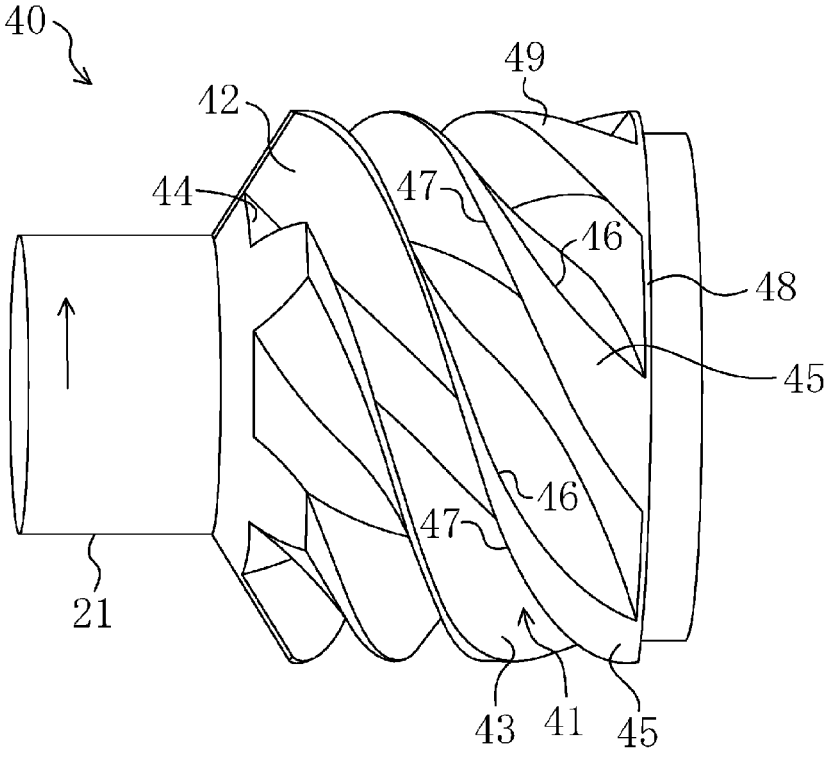
[FIG. 4]

As shown in FIGS. 3 and 4, the screw rotor (40) is a substantially columnar metal member. The screw rotor (40) is rotatably inserted in the cylindrical wall (30). The screw rotor (40) includes a plurality of helical grooves (41) (six helical grooves in the present embodiment) extending helically from an end to the other end of the screw rotor (40). Each of the helical grooves (41) is a continuous recess formed in the outer peripheral surface of the screw rotor (40), and constitutes a fluid chamber (23).

Each of the helical grooves (41) of the screw rotor (40) has a left end in FIG. 4 as a start end, and a right end in FIG. 4 as a terminal end. In FIG. 4, a left end face (an end face through which the refrigerant is sucked) of the screw rotor (40) is tapered. In the screw rotor (40) shown in FIG. 4, the start ends of the helical grooves (41) are opened in the tapered left end face, while the terminal ends of the helical grooves (41) are not opened in a right end face. Each of the helical grooves (41) has a front wall (42) which is a sidewall positioned forward in a direction of rotation of the screw rotor (40), and a back wall (43) which is a sidewall positioned backward in the direction of rotation of the screw rotor (40).

Part of the outer peripheral surface (49) of the screw rotor (40) sandwiched between two adjacent helical grooves (41) constitutes a circumferential sealing face (45). An edge of the circumferential sealing face (45) positioned forward in the direction of rotation of the screw rotor (40) constitutes a front edge (46), and the other edge positioned backward in the direction of rotation of the screw rotor (40) constitutes a back edge (47). Part of the outer peripheral surface (49) of the screw rotor (40) adjacent to the terminal ends of the helical grooves (41) constitutes an axial sealing face (48). The axial sealing face (48) is a circumferential surface extending along the end face of the screw rotor (40).

As described above, the screw rotor (40) is inserted in the cylindrical wall (30). The circumferential sealing face (45) and the axial sealing face (48) of the screw rotor (40) slide on an inner peripheral surface (35) of the cylindrical wall (30).

The circumferential sealing face (45) and the axial sealing face (48) of the screw rotor (40) are not in physical contact with the inner peripheral surface (35) of the cylindrical wall (30), and a minimum clearance is provided between the sealing faces and the inner peripheral surface to allow smooth rotation of the screw rotor (40). An oil film made of the refrigeration oil is formed between the circumferential sealing face (45) and the axial sealing face (48) of the screw rotor (40), and the inner peripheral surface (35) of the cylindrical wall (30). The oil film ensures gastightness of the fluid chamber (23).

Each of the gate rotors (50) is a resin member including a plurality of radially arranged, rectangular plate-shaped gates (51) (11 gates in this embodiment). Each of the gate rotors (50) is arranged outside the cylindrical wall (30) to be axially symmetric with an axis of rotation of the screw rotor (40). Specifically, in the screw compressor (1) of the present embodiment, the two gate rotors (50) are arranged at equal angular intervals about the axis of rotation of the screw rotor (40) (at 180° intervals in the present embodiment). A shaft center of each of the gate rotors (50) is perpendicular to a shaft center of the screw rotor (40). Each of the gate rotors (50) is arranged in such a manner that the gates (51) penetrate part of the cylindrical wall (30) to mesh with the helical grooves (41) of the screw rotor (40).

With the gate (51) meshed with the helical groove (41) of the screw rotor (40), side surfaces of the gate slide on the front wall (42) and the back wall (43) of the helical groove (41), respectively, and a tip end of the gate slides on a bottom (44) of the helical groove (41). A minimum clearance is provided between the gate (51) meshed with the helical groove (41) and the screw rotor (40) to allow smooth rotation of the screw rotor (40). An oil film made of the refrigeration oil is formed between the gate (51) meshed with the helical groove (41) and the screw rotor (40). The oil film ensures gastightness of the fluid chamber (23).

The gate rotors (50) are attached to metal rotor supports (55), respectively (see FIGS. 2 and 3). Each of the rotor supports (55) includes a base (56), arms (57), and a shaft (58). The base (56) is in the shape of a slightly thick disc. The number of the arms (57) is the same as the number of the gates (51) of the gate rotor (50), and the arms extend radially outward from an outer peripheral surface of the base (56). The shaft (58) is in the shape of a rod, and is placed to stand on the base (56). A center axis of the shaft (58) coincides with a center axis of the base (56). The gate rotor (50) is attached to be opposite the rod (58) with respect to the base (56) and the arms (57). The arms (57) are in contact with rear surfaces of the gates (51), respectively.

Each of the rotor supports (55) to which the gate rotor (50) is attached is placed in a gate rotor chamber (90) which is provided adjacent to the cylindrical wall (30) in the casing (10) (see FIG. 2). The rotor support (55) on the right of the screw rotor (40) in FIG. 2 is arranged with the gate rotor (50) facing downward. The rotor support (55) on the left of the screw rotor (40) in FIG. 2 is arranged with the gate rotor (50) facing upward. The shaft (58) of each of the rotor supports (55) is rotatably supported by a bearing housing (91) in the gate rotor chamber (90) through ball bearings (92, 93). Each of the gate rotor chambers (90) communicates with the low pressure space (S1).

The screw compressor (1) includes a slide valve (70) for controlling a capacity. The slide valve (70) is placed in a slide valve container (31). The slide valve container (31) is formed with two parts of the cylindrical wall (30) expanded radially outward, and is substantially semi-cylindrical extending from the discharge end (the right end in FIG. 1) to an inlet end (the right end in FIG. 1). The slide valve (70) is slidable in the axial direction of the cylindrical wall (30), and faces a circumferential surface of the screw rotor (40) when inserted in the slide valve container (31). Details of the slide valve (70) will be described later.

Communication passages (32) are formed in the casing (10) outside the cylindrical wall (30). The communication passages (32) are provided to correspond to the two parts of the slide valve container (31), respectively. The communication passage (32) is a passage extending in the axial direction of the cylindrical wall (30), and has an end opened in the low pressure space (S1), and the other end opened in the inlet end of the slide valve container (31). Part of the cylindrical wall (30) adjacent to the other end of the communicating path (32) (a right end in FIG. 1) constitutes a seat portion (11) to which an end face (P2) of the slide valve (70) abuts. A face of the seat portion (11) facing the end face (P2) of the slide valve (70) constitutes a seat surface (P1). The seat surface (P1) of the cylindrical wall (30) is shaped to correspond to the end face (P2) of the slide valve (70), and every part thereof can be in close contact with the end face (P2) of the slide valve (70).

When the slide valve (70) slides closer to the high pressure space (S2) (to the right provided that the axial direction of the drive shaft (21) shown in FIG. 1 is the right-left direction), an axial clearance is formed between the end face (P1) of the slide valve container (31) and the end face (P2) of the slide valve (70). The axial clearance and the communicating path (32) constitute a bypass passage (33) through which the refrigerant returns from the fluid chamber (23) to the low pressure space (S1). Specifically, an end of the bypass passage (33) communicates with the low pressure space (S1), and the other end can be opened in the inner peripheral surface (35) of the cylindrical wall (30). When the end face (P1) of the slide valve container (31) and the end face (P2) of the slide valve (70) are separated from each other, an opening formed between the end faces constitutes an opening (34) of the bypass passage (33) in the inner peripheral surface (35) of the cylindrical wall (30). When the slide valve (70) is moved, an area of the opening (34) of the bypass passage (33) is changed, and a capacity of the compression mechanism (20) is changed.

The screw compressor (1) includes a slide valve driving mechanism (80) for sliding the slide valve (70) (see FIG. 1). The slide valve driving mechanism (80) includes a cylinder (81) fixed to the bearing holder (60), a piston (82) inserted in the cylinder (81), an arm (84) coupled to a piston rod (83) of the piston (82), a coupling rod (85) which couples the arm (84) and the slide valve (70), and a spring (86) which biases the arm (84) to the right in FIG. 1 (to the direction in which the arm (84) is separated from the casing (10)).

In the slide valve driving mechanism (80) shown in FIG. 1, inner pressure in space on the left of the piston (82) (space adjacent to the piston (82) closer the screw rotor (40)) is higher than inner pressure in space on the right of the piston (82) (space adjacent to the piston (82) closer to the arm (84)). The slide valve driving mechanism (80) is configured to adjust the position of the slide valve (70) by adjusting the inner pressure in the space on the right of the piston (82) (i.e., gas pressure in the right space).

While the screw compressor (1) is operated, suction pressure of the compression mechanism (20) is acted on one of axial end faces of the slide valve (70), and discharge pressure of the compression mechanism (20) is acted on the other axial end face. Thus, during the operation of the screw compressor (1), the slide valve (70) always receives force which presses the slide valve (70) toward the low pressure space (S1). When the inner pressures in the spaces on the left and right of the piston (82) in the slide valve driving mechanism (80) are changed, force which pulls the slide valve (70) back to the high pressure space (S2) is changed, thereby changing the position of the slide valve (70).

Details of the configuration of the slide valve (70), and details of the shape of the opening (34) of the bypass passage (33) in the inner peripheral surface (35) of the cylindrical wall (30) will be described with reference to FIGS. 5-7.

Figure 5:
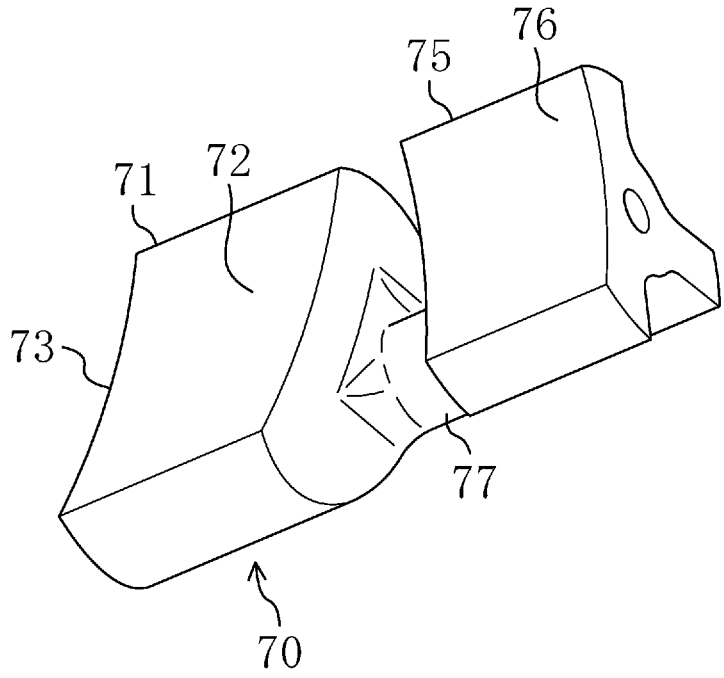
[FIG. 5]
Figure 6:
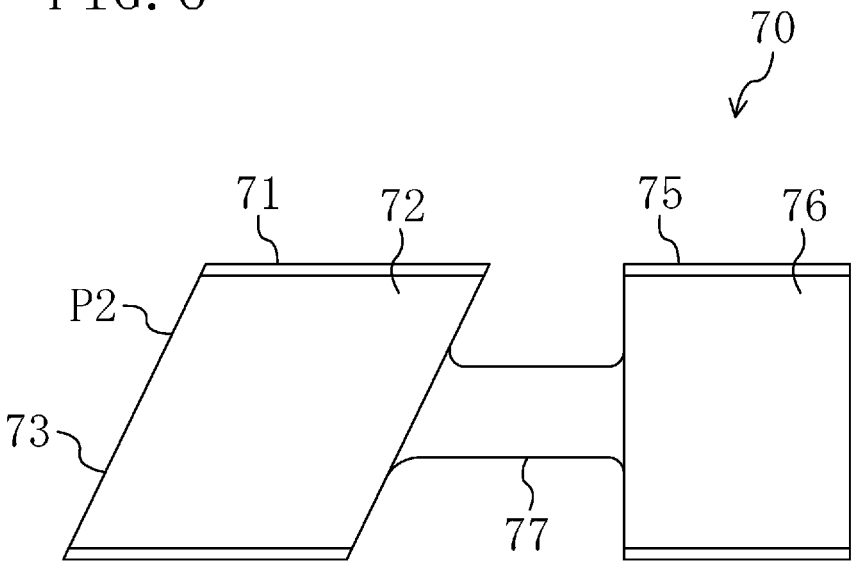
[FIG. 6]

As shown in FIGS. 5 and 6, the slide valve (70) includes a valve portion (71), a guide portion (75), and a coupling portion (77). The valve portion (71), the guide portion (75), and the coupling portion (77) of the slide valve (70) are formed with a single metal member. Specifically, the valve portion (71), the guide portion (75), and the coupling portion (77) are integrated.

The valve portion (71) is in the shape of a solid column which is partially cut away, and is placed in the casing (10) with the cut portion facing the screw rotor (40). A counter surface (72) of the valve portion (71) facing the screw rotor (40) is a curved surface having the same radius of curvature as the inner peripheral surface (35) of the cylindrical wall (30), and extends in the axial direction of the valve portion (71). The counter surface (72) of the valve portion (71) slides on the screw rotor (40).

End faces of the valve portion (71) are inclined relative to the axial direction of the valve portion (71). The inclination of the inclined end faces of the valve portion (71) is substantially the same as the inclination of the helical groove (41) of the screw rotor (40). The end face of the valve portion (71) on the left in FIG. 6 constitutes an end face (P2) of the slide valve (70). Specifically, the end face (P2) of the slide valve (70) is inclined along an extending direction of the helical groove (41) of the screw rotor (40). The end face (P2) is perpendicular to the counter surface (72) of the valve portion (71). An edge of the end face (P2) of the slide valve (70) adjacent to the screw rotor (40) (i.e., an edge forming a boundary between the end face (P2) and the counter surface (72)) constitutes a screw-side edge (73).

The guide portion (75) is in the shape of a column having a T-shaped cross-section. A side surface of the guide portion (75) corresponding to an arm of the T-shaped cross-section (i.e., a front side surface in FIG. 5) is a curved surface having the same radius of curvature as the inner peripheral surface (35) of the cylindrical wall (30), and constitutes a sliding surface (76) which slides on the outer peripheral surface of the bearing holder (60). The sliding surface (76) of the guide portion (75) of the slide valve (70) faces the same direction as the counter surface (72) of the valve portion (71), and is arranged at an interval from the valve portion (71).

The coupling portion (77) is in the shape of a relatively short column, and couples the valve portion (71) and the guide portion (75). The coupling portion (77) is positioned opposite the counter surface (72) of the valve portion (71) and the sliding surface (76) of the guide portion (75). Space between the valve portion (71) and the guide portion (75) of the slide valve (70) and space behind the guide portion (75) (i.e., space opposite the sliding surface (76)) form a passage for discharged gaseous refrigerant, and space between the counter surface (72) of the valve portion (71) and the sliding surface (76) of the guide portion (75) is the outlet (25). The high pressure space (S2) communicates with the fluid chamber (23) through the outlet (25).

Figure 7:
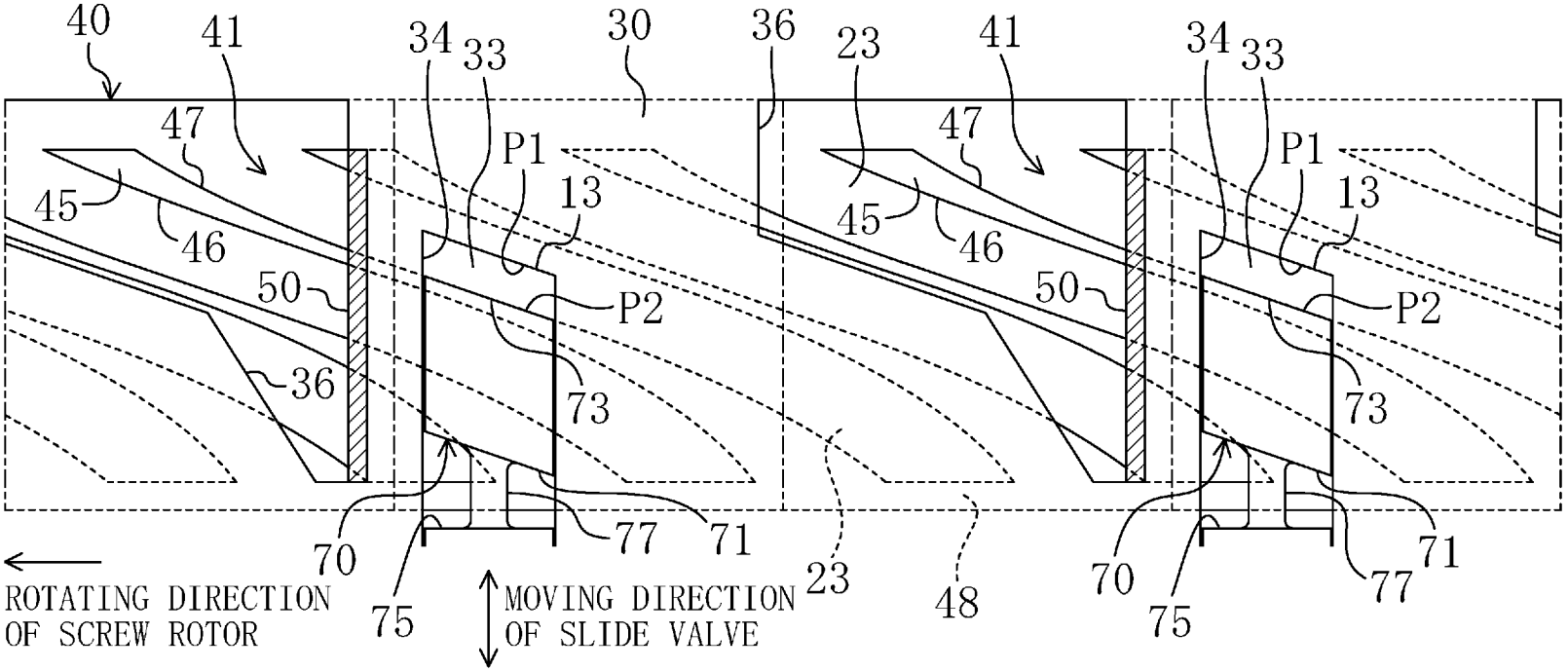
[FIG. 7]

When the end face (P2) of the slide valve (70) is separated from the seat surface (P1) of the cylindrical wall (30) as shown in FIG. 7, the bypass passage (33) is opened in the inner peripheral surface (35) of the cylindrical wall (30). Specifically, the opening (34) of the bypass passage (33) in the inner peripheral surface (35) of the cylindrical wall (30) is sandwiched between the end face (P2) of the slide valve (70) and the seat surface (P1) of the cylindrical wall (30).

As described above, the edge of the end face (P2) of the slide valve (70) adjacent to the screw rotor (40) constitutes the screw-side edge (73). When developed on a plane, the screw-side edge (73) draws a straight line which is inclined along the front edge (46) and the back edge (47) of the circumferential sealing face (45) of the screw rotor (40) (i.e., a straight line which extends in the extending direction of the helical groove (41), and forms a predetermined angle with the circumferential direction of the screw rotor (40)). The screw-side edge (73) is shaped in such a manner that every part thereof can overlap the circumferential sealing face (45) of the screw rotor (40).

As described above, the shape of the seat surface (P1) of the cylindrical wall (30) corresponds to the shape of the end face (P2) of the slide valve (70), and every part of the seat surface can be in close contact with the end face (P2) of the slide valve (70). Specifically, the seat surface (P1) of the cylindrical wall (30) is perpendicular to the inner peripheral surface (35) of the cylindrical wall (30). The edge of the seat surface (P1) of the cylindrical wall (30) adjacent to the screw rotor (40) (i.e., an edge forming a boundary between the seat surface (P1) and the inner peripheral surface (35)) constitutes a screw-side edge (13). The screw-side edge (13) is parallel to the screw-side edge (73) of the slide valve (70). Specifically, when developed on a plane, the screw-side edge (13) of the cylindrical wall (30) and the screw-side edge (73) of the slide valve (70) constitute lines parallel to each other. Thus, the opening (34) of the bypass passage (33) in the inner peripheral surface (35) of the cylindrical wall (30) forms a parallelogram when developed on a plane.

—Working Mechanism—

Figure 8:
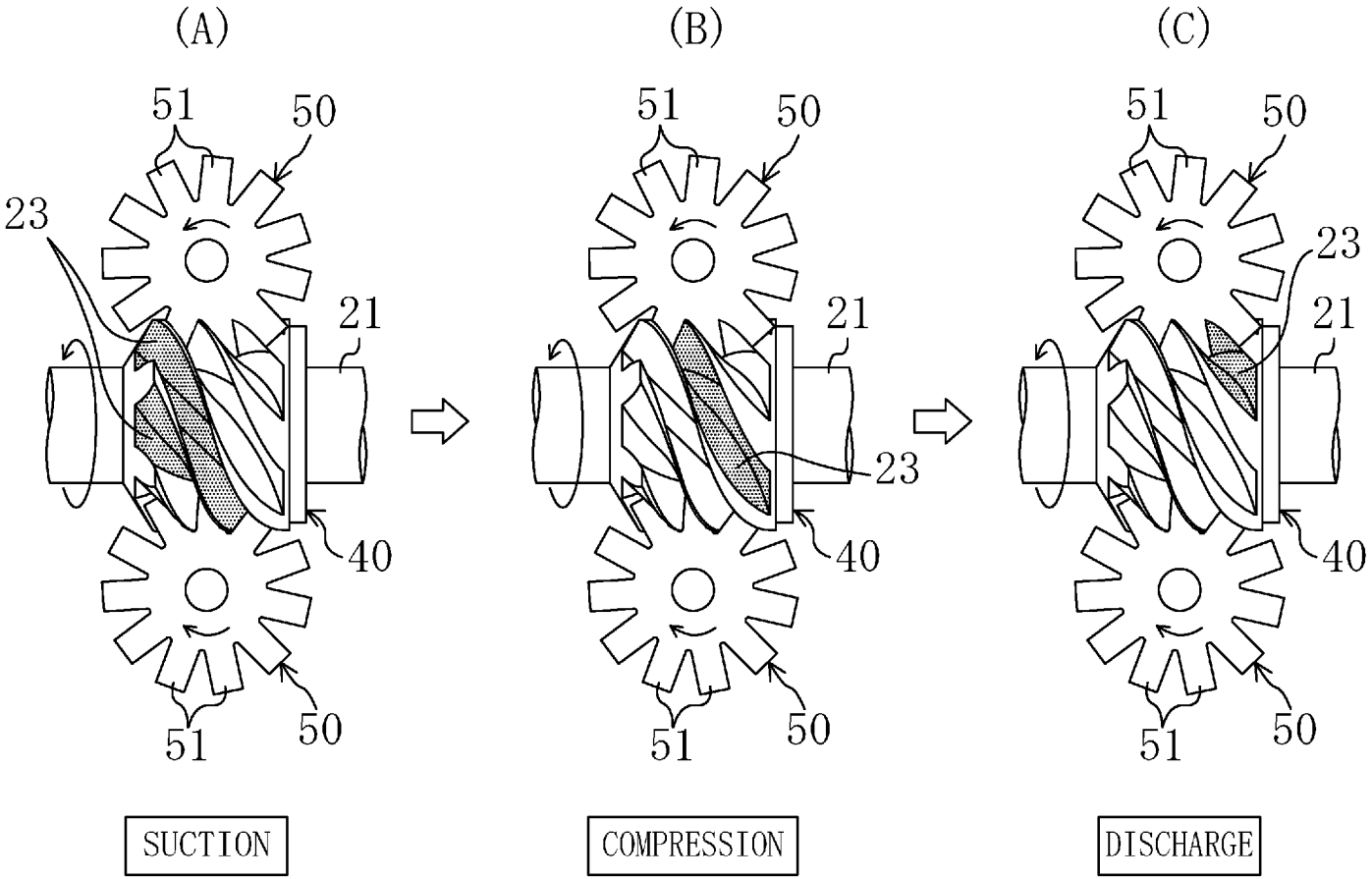
[FIG. 8]

A general working mechanism of the screw compressor (1) will be described with reference to FIG. 8.

When an electric motor of the screw compressor (1) is driven, the drive shaft (21) is rotated to rotate the screw rotor (40). As the screw rotor (40) is rotated, the gate rotors (50) are also rotated, and a suction phase, a compression phase, and a discharge phase of the compression mechanism (20) are repeated. In the following description, the fluid chamber (23) which is shaded in FIG. 8 will be described.

In FIG. 8(A), the shaded fluid chamber (23) communicates with the low pressure space (S1). The helical groove (41) constituting the fluid chamber (23) meshes with the gate (51) of the lower gate rotor (50) shown in FIG. 8(A). When the screw rotor (40) is rotated, the gate (51) relatively moves toward the terminal end of the helical groove (41), thereby increasing volume of the fluid chamber (23). Thus, the low pressure gaseous refrigerant in the low pressure space (S1) is sucked into the fluid chamber (23).

When the screw rotor (40) is further rotated, the fluid chamber (23) enters the state shown in FIG. 8(B). As shown in FIG. 8(B), the shaded fluid chamber (23) is completely closed. Thus, the helical groove (41) constituting this fluid chamber (23) meshes with the gate (51) of the upper gate rotor (50) shown in FIG. 8(B), and is divided from the low pressure space (S1) by the gate (51) and the cylindrical wall (30). When the gate (51) relatively moves toward the terminal end of the helical groove (41) as the screw rotor (40) is rotated, the volume of the fluid chamber (23) is gradually reduced. Thus, the gaseous refrigerant in the fluid chamber (23) is compressed.

When the screw rotor (40) is further rotated, the fluid chamber (23) enters the state shown in FIG. 8(C). In FIG. 8(C), the shaded fluid chamber (23) communicates with the high pressure space (S2) through the outlet (25). When the gate (51) relatively moves toward the terminal end of the helical groove (41) as the screw rotor (40) is rotated, the compressed refrigerant gas is pushed out of the fluid chamber (23) to the high pressure space (S2).

Control of the capacity of the compression mechanism (20) using the slide valve (70) will be described below with reference to FIG. 1. The capacity of the compression mechanism (20) is the same as the operating capacity of the screw compressor (1), and designates an "amount of the refrigerant discharged from the compression mechanism (20) to the high pressure space (S2) in unit time."

When the slide valve (70) is pushed to the leftmost position in FIG. 2, the end face (P2) of the slide valve (70) is pressed onto the seat surface (P1) of the seat portion (13), and the capacity of the compression mechanism (20) is maximized. In this state, the bypass passage (33) is completely closed by the valve portion (71) of the slide valve (70), and all the gaseous refrigerant sucked from the low pressure space (S1) to the fluid chamber (23) is discharged to the high pressure space (S2).

When the slide valve (70) moves to the right in FIG. 1, and the end face (P2) of the slide valve (70) is separated from the seat surface (P1), the bypass passage (33) is opened in the inner peripheral surface (35) of the cylindrical wall (30). In this state, part of the gaseous refrigerant sucked from the low pressure space (S1) to the fluid chamber (23) returns from the fluid chamber (23) in the compression phase to the low pressure space (S1) through the bypass passage (33), and the rest of the refrigerant is compressed, and is discharged to the high pressure space (S2). As the distance between the end face (P2) of the slide valve (70) and the seat surface (P1) of the slide valve container (31) increases, the amount of the refrigerant returning to the low pressure space (S1) through the bypass passage (33) increases, and the amount of the refrigerant discharged to the high pressure space (S2) is reduced (i.e., the capacity of the compression mechanism (20) is reduced).

The refrigerant discharged from the fluid chamber (23) to the high pressure space (S2) first flows into the outlet (25) formed in the slide valve (70). Then, the refrigerant flows into the high pressure space (S2) through the passage formed behind the guide portion (75) of the passage slide valve (70).

—Change in Actual Bypass Area—

As described above, the opening (34) of the bypass passage (33) is formed in the inner peripheral surface (35) of the cylindrical wall (30) when the end face (P2) of the slide valve (70) is separated from the seat surface (P1) of the cylindrical wall (30). While the screw rotor (40) is rotated, the helical groove (41) of the screw rotor (40) moves in the circumferential direction of the screw rotor (40). The refrigerant in the fluid chamber (23) flows into the bypass passage (33) through part of the opening (34) of the bypass passage (33) overlapping the helical groove (41).

In the following description, attention is paid to one of the helical grooves (41*a*) formed in the screw rotor (40), and a change in area of the opening (34) of the bypass passage (33) overlapping the helical groove (41*a*) (hereinafter referred to as an "actual bypass area") will be described with reference to FIGS. 9-13.

FIGS. 9-12 are developments of the screw rotor (40), in which one of the gate rotors (50), and the opening (34) of the bypass passage (33) formed by the corresponding slide valve (70) are shown. In FIGS. 9-12 illustrating the opening (34) of the bypass passage (33), the distance between the end face (P2) of the slide valve (70) and the seat surface (P1) of the cylindrical wall (30) is maximized (i.e., the capacity of the compression mechanism (20) is minimized). FIGS. 9-12 show an opening (534) of a conventional bypass passage with a dotted line. The opening of the conventional bypass passage is in the position at which the capacity of the compression mechanism is minimized.

Figure 9:
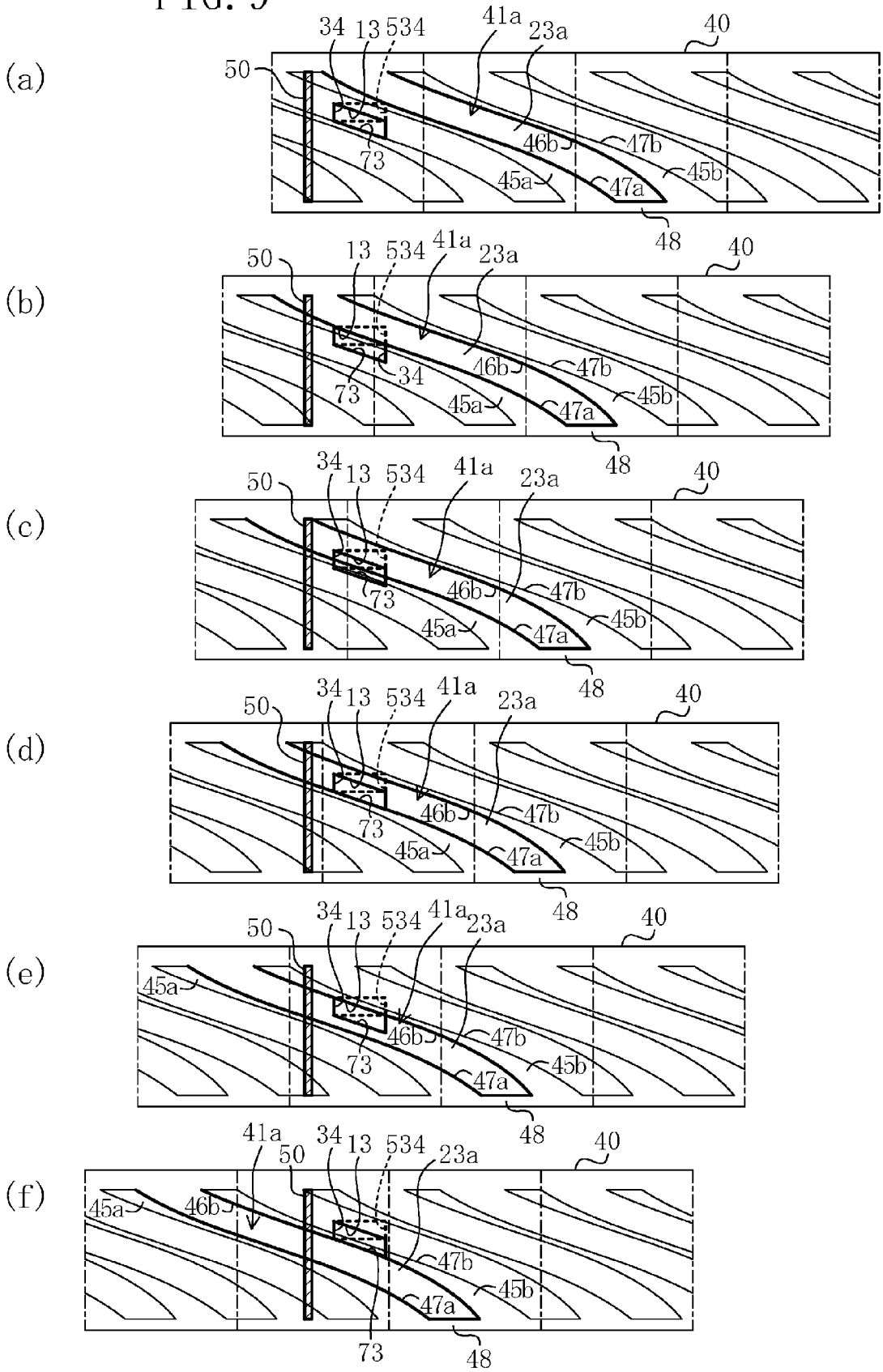
[FIG. 9] FIGS. 9(*a*)-9(*f*) are developments of the screw rotor illustrating how a positional relationship between an opening of a bypass passage and a helical groove changes.
Figure 10:
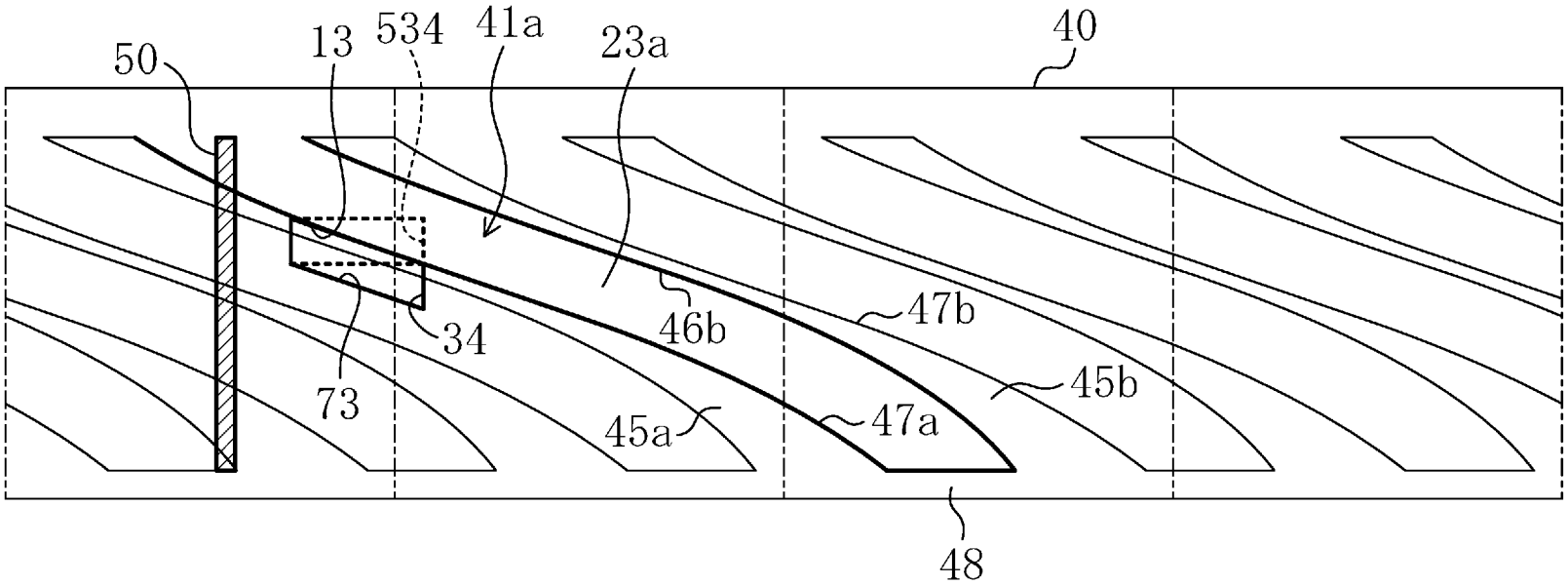
[FIG. 10]

FIG. 9(*a*) shows the opening (534) of the conventional bypass passage which is about to overlap the helical groove (41*a*). When the screw rotor (40) is rotated in this state, a positional relationship between the opening and the helical groove is changed as shown in FIG. 9(*b*). As shown in an enlargement in FIG. 10, the opening (34) of the bypass passage (33) of the present embodiment is about to overlap the helical groove (41*a*) in the state shown in FIG. 9(*b*).

When the screw rotor (40) is rotated in the state shown in FIG. 9(*b*), a back edge (47*a*) of a circumferential sealing face (45*a*) positioned forward of the helical groove (41*a*) passes the screw-side edge (13) of the cylindrical wall (30), and part of the opening (34) of the bypass passage (33) overlaps the helical groove (41*a*). Thus, a fluid chamber (23*a*) formed by the helical groove (41*a*) communicates with the bypass passage (33), and the refrigerant starts to flow from the fluid chamber (23*a*) to the bypass passage (33). The actual bypass area is gradually increased until the positional relationship is changed to the state of FIG. 9(*d*) described later.

When the screw rotor (40) is rotated in the state shown in FIG. 9(*b*), the positional relationship is changed as shown in FIG. 9(*c*). FIG. 9(*c*) shows that the fluid chamber (23*a*) formed by the helical groove (41*a*) is divided from the low pressure space (S1) by the gate (51) entering the start end of the helical groove (41*a*). Specifically, the fluid chamber (23*a*) formed by the helical groove (41*a*) communicates with the low pressure space (S1) at the start end of the helical groove (41*a*) until the positional relationship is changed to the state of FIG. 9(*c*). Thus, a pressure of the refrigerant in the fluid chamber (23*a*) is kept substantially equal to a pressure of the refrigerant in the low pressure space (S1) until the positional relationship is changed to the state of FIG. 9(*c*). Immediately after when the positional relationship is changed as shown in FIG. 9(*c*), the refrigerant in the fluid chamber (23*a*) is returned to the low pressure space (S1) after passing through the bypass passage (33) only.

When the screw rotor (40) is rotated in the state shown in FIG. 9(*c*), the positional relationship is changed as shown in FIG. 9(*d*). As shown in an enlargement in FIG. 11(A), FIG. 9(*d*) shows that the back edge (47*a*) of the circumferential sealing face (45*a*) positioned forward of the helical groove (41*a*) is about to pass the screw-side edge (73) of the slide valve (70). When the screw rotor (40) is rotated in the state of FIG. 9(*d*), the positional relationship is changed as shown in FIG. 9(*e*). As shown in an enlargement in FIG. 11(B), FIG. 9(*e*) shows that a front edge (46*b*) of a circumferential sealing face (45*b*) positioned backward of the helical groove (41*a*) has started to intersect with the screw-side edge (13) of the cylindrical wall (30). In a period from the state of FIG. 9(*d*) to the state of FIG. 9(*e*), every part of the opening (34) of the bypass passage (33) keeps overlapping the helical groove (41*a*), and the actual bypass area is kept equal to an area $A_o$ of the opening (34) of the bypass passage (33).

When the screw rotor (40) is rotated in the state shown in FIG. 9(*e*), the actual bypass area is gradually reduced, and the positional relationship is changed as shown in FIG. 9(*f*). As shown in an enlargement in FIG. 12, FIG. 9(*f*) shows that the front edge (46*b*) of the circumferential sealing face (45*b*) positioned backward of the helical groove (41*a*) is about to pass the screw-side edge (73) of the slide valve (70). In the state shown in FIG. 9(*f*), every part of the screw-side edge (73) of the slide valve (70) overlaps the circumferential sealing face (45*b*).

In the state of FIG. 9(*f*), the fluid chamber (23*a*) formed by the helical groove (41*a*) is blocked from the bypass passage (33), and the fluid chamber (23*a*) is completely blocked from the low pressure space (S1). When the screw rotor (40) is rotated in the state of FIG. 9(*f*), the gate (51) moves, thereby reducing the volume of the fluid chamber (23*a*), and compressing the refrigerant in the fluid chamber (23*a*).

Figure 13:
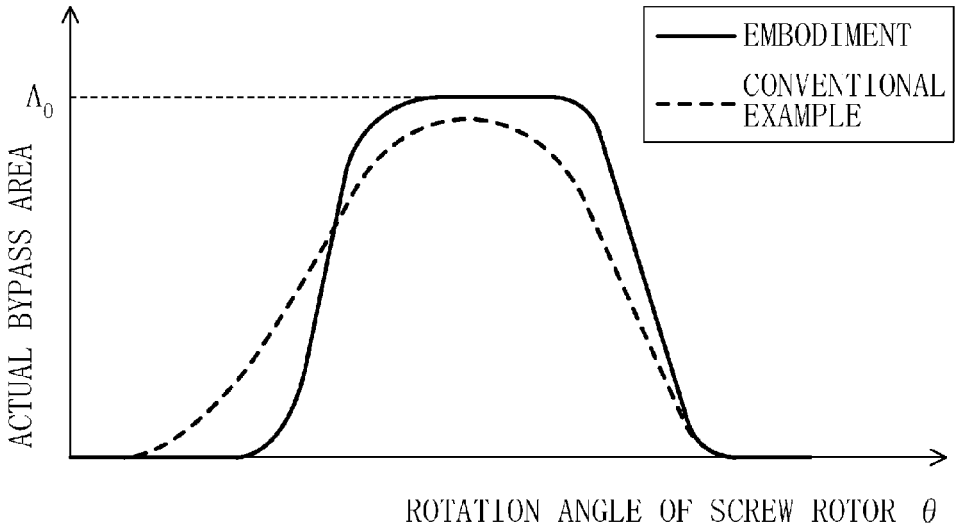
[FIG. 13]

FIG. 13 shows a graph of the change in actual bypass area described above. As indicated by a solid line in FIG. 13, the actual bypass area according to the present embodiment is gradually increased from the state of FIG. 9(*b*), and is maximized in the state of FIG. 9(*d*) (i.e., becomes equal to the area $A_0$ of the opening (34) of the bypass passage (33)). Then, the actual bypass area is kept to the maximum until the positional relationship is changed as shown in FIG. 9(*e*), and is then gradually reduced until when the positional relational ship is changed as shown in FIG. 9(*f*).

FIG. 13 shows a dotted line indicating a change in actual bypass area of the opening (534) of the conventional bypass passage. As shown in FIG. 9(*a*), the opening (534) of the conventional bypass passage starts to overlap the helical groove (41*a*) earlier than the opening (34) of the bypass passage (33) of the present embodiment. Thus, the actual bypass area of the opening (534) of the conventional bypass passage starts to increase when a rotation angle of the screw rotor (40) is smaller than that of the present embodiment.

The actual bypass area of the opening (534) of the conventional bypass passage is gradually increased as the screw rotor (40) is rotated. However, a rate of the increase is lower than that of the present embodiment. As the screw rotor (40) is further rotated, the actual bypass area of the opening (534) of the conventional bypass passage is maximized, and is then gradually reduced, and reaches zero when the positional relationship is changed as shown in FIG. 9(*f*).

As apparently shown in FIGS. 9(*c*) and 9(*d*), part of the opening (534) of the conventional bypass passage is always shifted from the helical groove (41*a*), and every part of the opening (534) would not simultaneously overlap the helical groove (41*a*). Thus, the maximum value of the actual bypass area of the opening (534) of the conventional bypass passage is smaller than the area $A_o$ of the opening (534).

In the present embodiment, the maximum value of the actual bypass area is larger than that of the conventional example. In particular, according to the present embodiment, the actual bypass area is kept equal to the area $A_0$ of the opening (34) of the bypass passage (33) in a predetermined period after the fluid chamber (23*a*) formed by the helical groove (41*a*) is divided from the low pressure space (51) by the gate (51). Thus, in the present embodiment, the pressure loss which occurs when the refrigerant passes through the opening (34) of the bypass passage (33) after the fluid chamber (23*a*) is divided from the low pressure space (51) by the gate (51) can be reduced as much as possible.

In the present embodiment, the actual bypass area in a last part of a period in which the opening (34) of the bypass passage (33) overlaps the helical groove (41*a*) is larger than the actual bypass area of the opening (534) of the conventional bypass passage (see FIG. 13). Thus, the pressure loss which occurs when the refrigerant passes through the opening (34) of the bypass passage (33) can be reduced, and an increase in pressure in the fluid chamber (23*a*) caused by the pressure loss can be reduced.

—Advantages of Embodiment—

According to the present embodiment, the end face (P2) of the slide valve (70) is inclined along the extending direction of helical groove (41) formed in the screw rotor (40). Thus, the opening (34) of the bypass passage (33) formed in the inner peripheral surface (35) of the cylindrical wall (30) is also inclined along the extending direction of the helical groove (41) formed in the screw rotor (40). This can increase the area of the opening (34) of the bypass passage (33) in the inner peripheral surface (35) of the cylindrical wall (30) overlapping the helical groove (41) (i.e., the actual bypass area), and can reduce the pressure loss which occurs when the refrigerant in the fluid chamber (23) flows into the bypass passage (33). Thus, the present embodiment can reduce power required to push the refrigerant in the fluid chamber (23) into the bypass passage (33), and can improve efficiency of operation of the screw compressor (1) when the bypass passage (33) is opened in the inner peripheral surface (35) of the cylindrical wall (30) (i.e., when the operating capacity of the screw compressor (1) is set lower than the maximum value).

According to the present embodiment, the screw-side edge (73) of the slide valve (70) is inclined along the helical groove (41) of the screw rotor (40) in such a manner that every part thereof can simultaneously overlap the circumferential sealing face (45) of the screw rotor (40). Thus, according to the present embodiment, the screw-side edge (73) of the slide valve (70) can reliably be shaped along the extending direction of the helical groove (41) of the screw rotor (40), thereby ensuring the sufficient actual bypass area.

Figure 11:
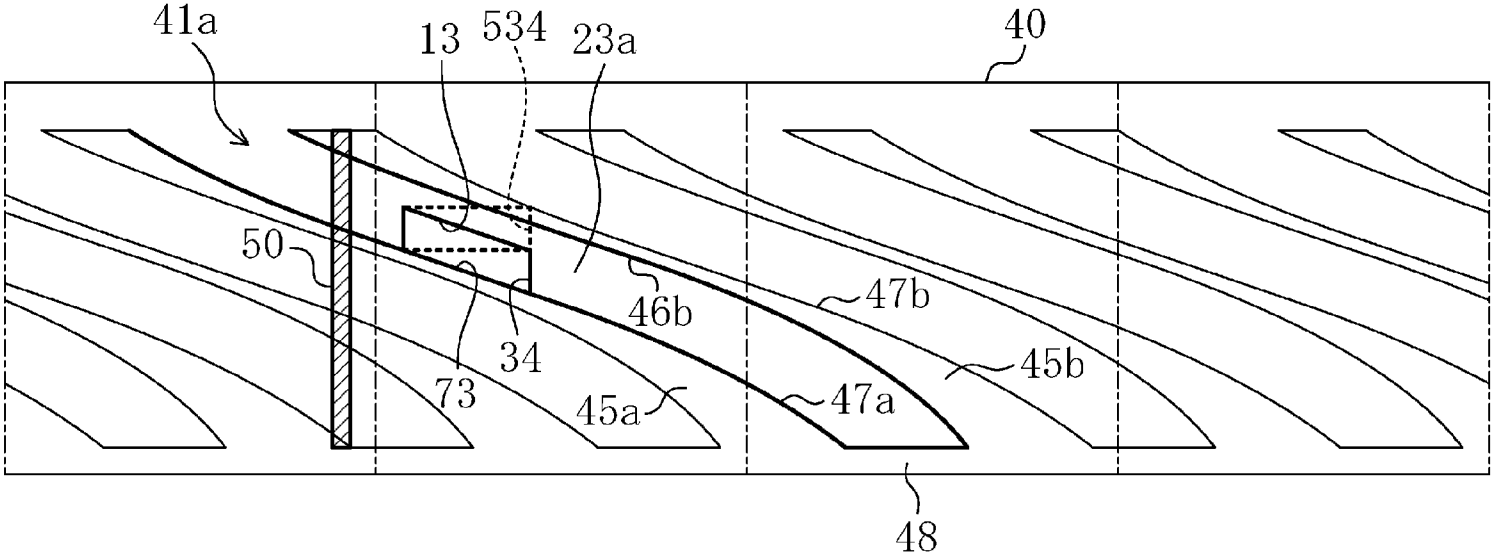
[FIG. 11]
Figure 11:
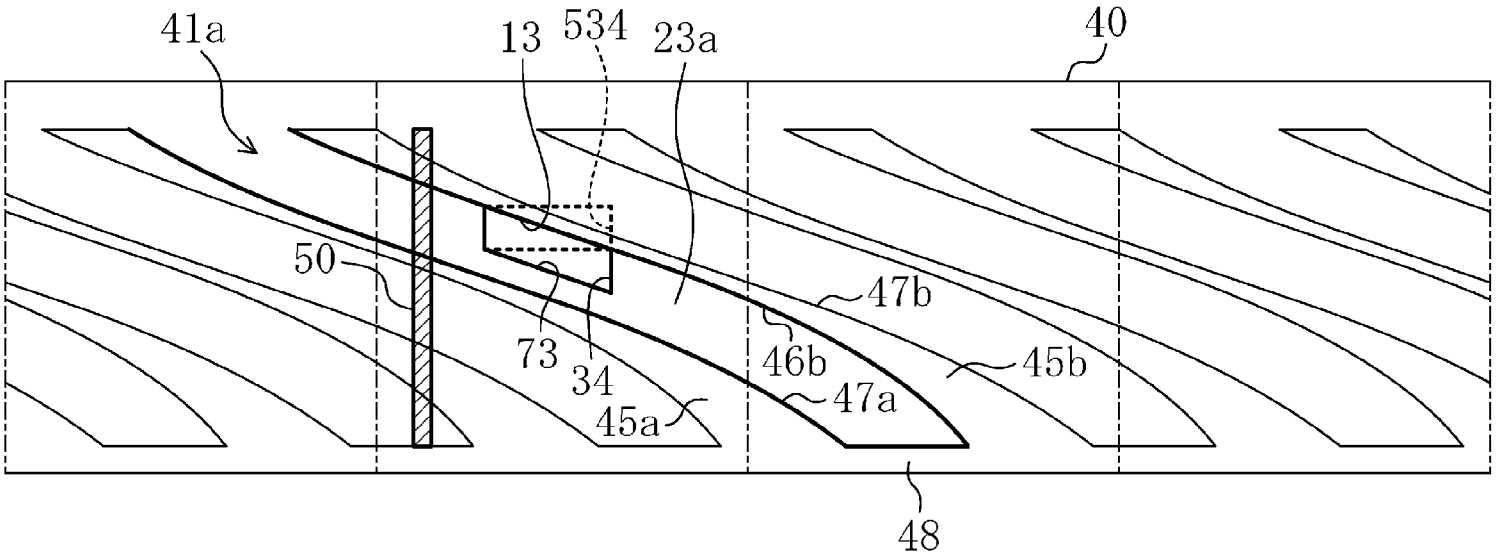
Figure 12:
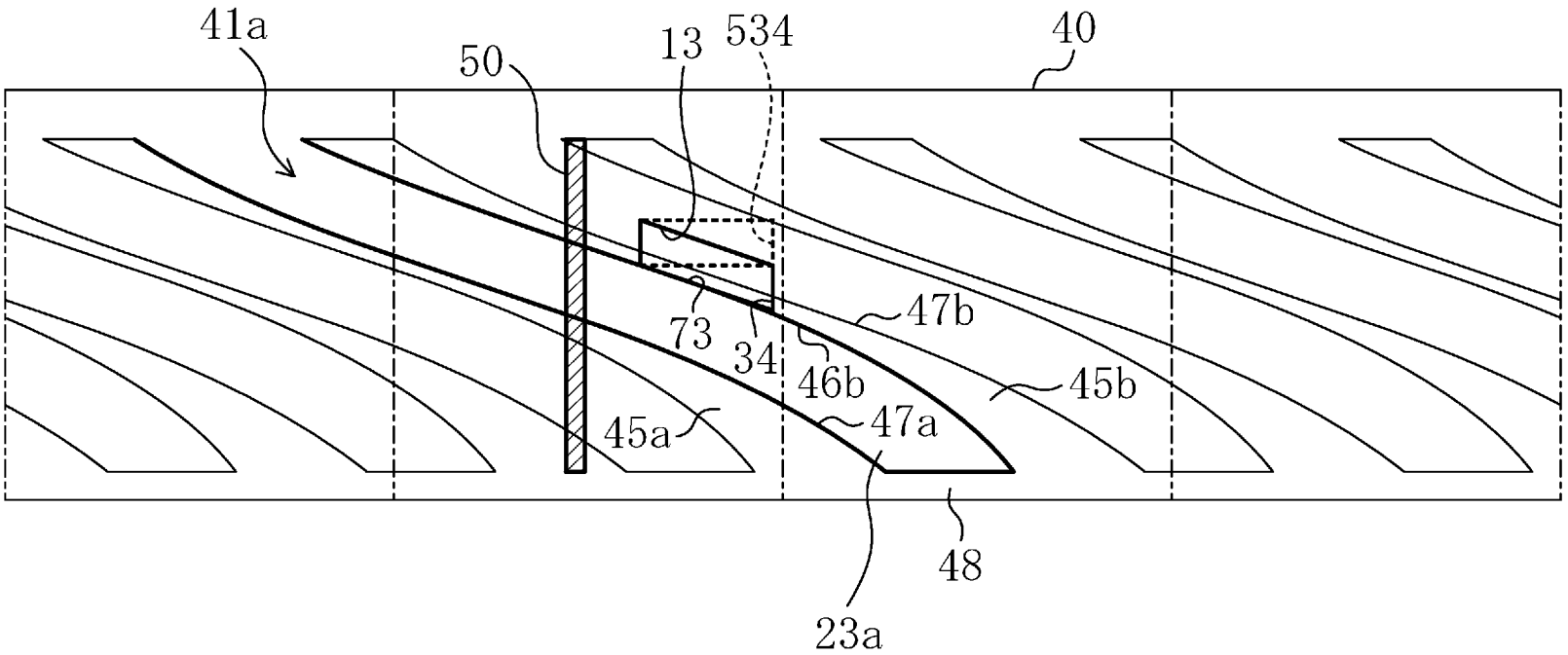
[FIG. 12]

In the present embodiment, the opening (34) of the bypass passage (33) formed in the inner peripheral surface (35) of the cylindrical wall (30) is temporarily fully opened in the fluid chamber (23) divided from the low pressure space (S1) by the gate (51) (see FIG. 11). Thus, in a period in which the refrigerant in the fluid chamber (23) is pushed into the bypass passage (33) by the gate (51), the actual bypass area can be maximized, and the power required to push the fluid in the fluid chamber (23) into the bypass passage (33) can reliably be reduced.

Figure 14:
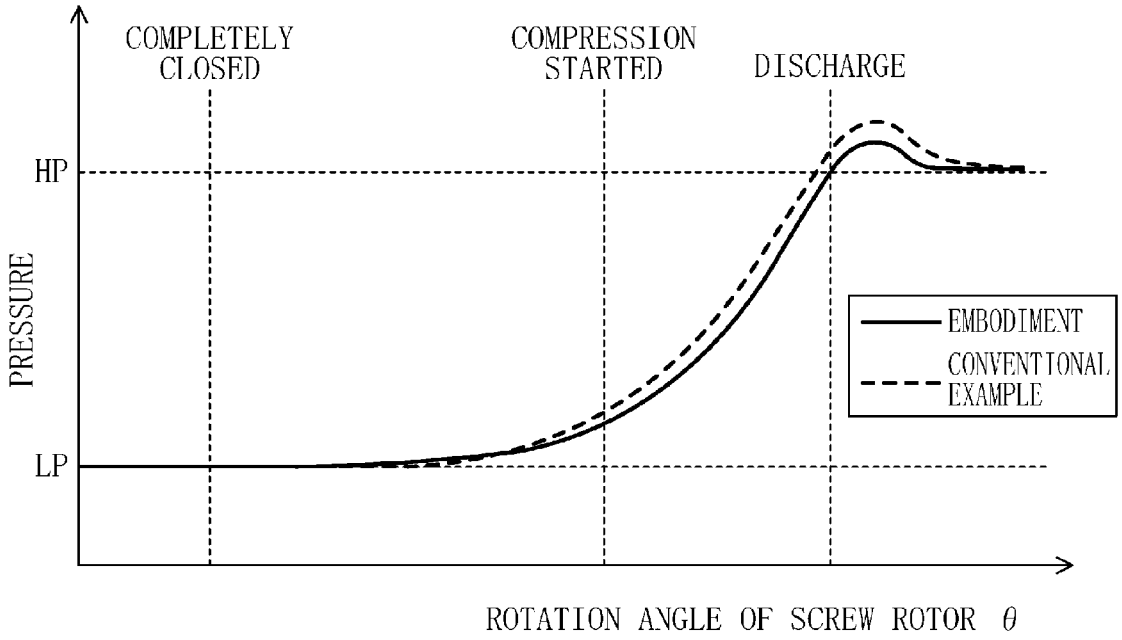
[FIG. 14]

As described above, the present embodiment can reduce the pressure loss which occurs when the refrigerant in the fluid chamber (23) flows into the bypass passage (33) as compared with the conventional example. Thus, according to the present embodiment, the increase in pressure of the refrigerant in the fluid chamber (23), which is caused by the pressure loss which occurs when the refrigerant in the fluid chamber (23) flows into the bypass passage (33), can be reduced, and loss by overcompression can be reduced. This will be described in detail with reference to FIG. 14.

A change in pressure of the refrigerant in a fluid chamber (523) in the conventional screw compressor will be described. As indicated by a dotted line in FIG. 14, the pressure of the refrigerant in the fluid chamber (523) of the conventional screw compressor is kept substantially equal to a refrigerant pressure LP in the low pressure space until the fluid chamber (523) is completely closed by the gate. After the fluid chamber (523) is completely closed by the gate, the pressure of the refrigerant in the fluid chamber (523) is gradually increased even when the fluid chamber (523) communicates with the bypass passage (533). This is because pressure loss occurs when the refrigerant in the fluid chamber (523) flows into the bypass passage (533), and the refrigerant in the fluid chamber (523) does not flow into the bypass passage (533) until the pressure of the refrigerant in the fluid chamber (523) becomes higher than the refrigerant pressure LP in the low pressure space. Then, when the fluid chamber (523) is blocked from the bypass passage (533) to become completely closed space, the pressure of the refrigerant in the fluid chamber (523) is abruptly increased, and temporarily exceeds the refrigerant pressure LP in the high pressure space. The refrigerant in the fluid chamber (523) then starts to flow into the high pressure space, and the pressure of the refrigerant in the fluid chamber (523) gradually approaches the refrigerant pressure HP in the high pressure space.

A change in pressure of the refrigerant in the fluid chamber (23) of the screw compressor (1) of the present embodiment will be described. As shown in FIGS. 9(*a*) and 9(*b*), the bypass passage (33) starts to communicate with the fluid chamber (23) of the present embodiment later than the conventional bypass passage (533) communicating with the conventional fluid chamber (523). Thus, at first, the pressure of the refrigerant in the fluid chamber (23) of the present embodiment is higher than the pressure in the conventional example as indicated by a solid line in FIG. 14. However, as shown in FIG. 13, the actual bypass area is abruptly increased in the present embodiment than in the conventional example. Thus, the pressure of the refrigerant in the fluid chamber (23) is increased more gently than in the conventional example, and is lower than that in the conventional example when the fluid chamber (23) is blocked from the bypass passage (33). Specifically, in the present embodiment, the pressure of the refrigerant in the fluid chamber (23) when the fluid chamber (23) is completely blocked from the low pressure space (S1) is lower than that in the conventional example. Thus, the maximum value of the pressure of the refrigerant in the fluid chamber (23) of the present embodiment is lower than that in the conventional example.

Thus, according to the present embodiment, the pressure of the refrigerant in the fluid chamber (23) immediately before the discharge of the refrigerant in the fluid chamber (23) to the high pressure space (S2) starts can be reduced as compared with the conventional example. Therefore, the present embodiment can reduce the power required to rotate the screw rotor (40) to compress the refrigerant in the fluid chamber (23), and can reduce loss by overcompression.

—First Alternative of Embodiment—

Figure 15:
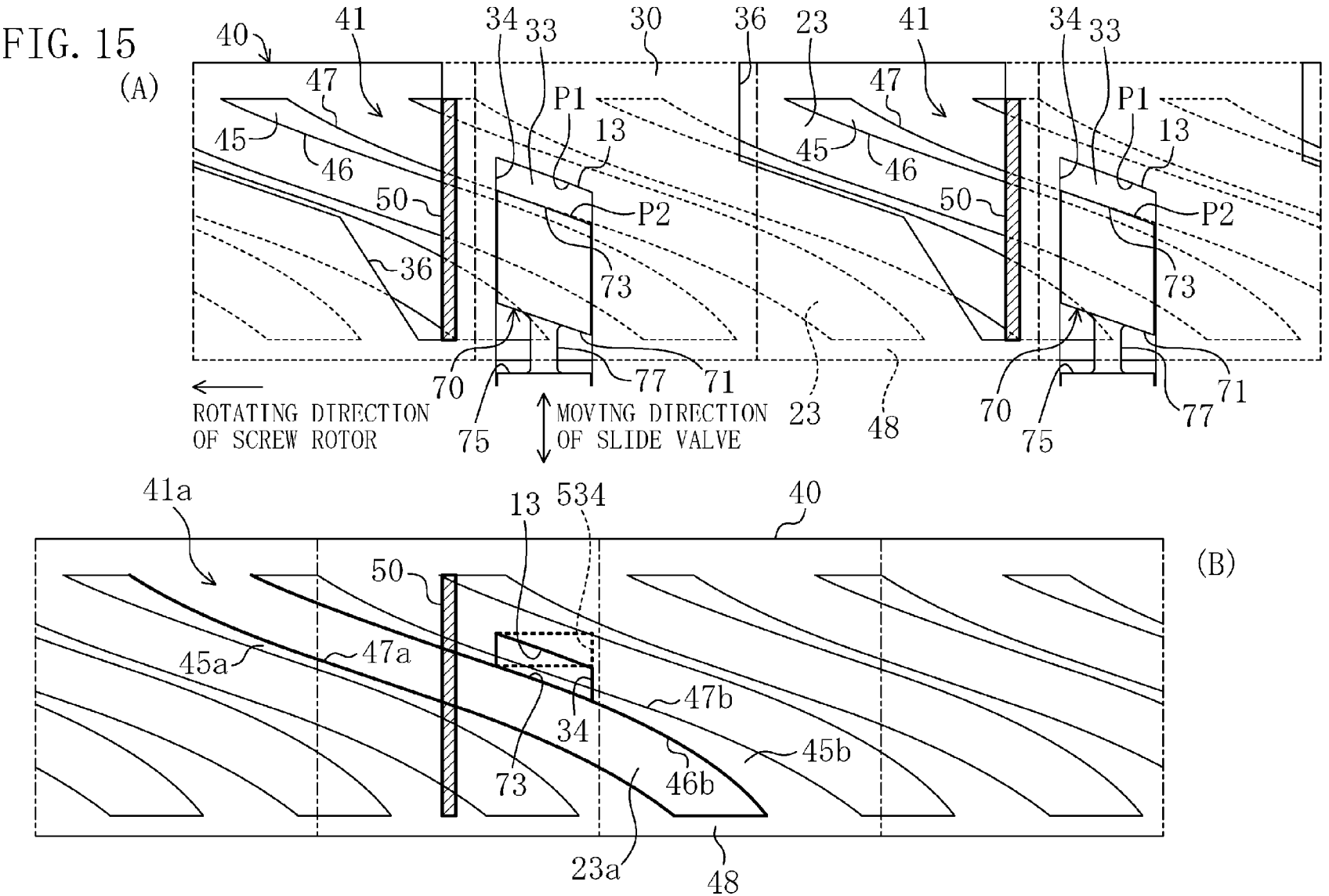
[FIG. 15]

As shown in FIG. 15, the screw-side edge (73) of the slide valve (70) of the present embodiment may be shaped to be parallel to the front edge (46) of the circumferential sealing face (45) of the screw rotor (40). As shown in FIG. 15(B), in this alternative, every part of the screw-side edge (73) of the slide valve (70) coincides the front edge (46*b*) of the circumferential sealing face (45*b*) positioned backward of the fluid chamber (23*a*) when the fluid chamber (23*a*) is blocked from the bypass passage (33).

In this alternative, the screw-side edge (13) of the cylindrical wall (30) is in the shape corresponding to the screw-side edge (73) of the slide valve (70). Specifically, in this alternative, both of the screw-side edge (73) of the slide valve (70) and the screw-side edge (13) of the cylindrical wall (30) are shaped to be parallel to the front edge (46) of the circumferential sealing face (45) of the screw rotor (40).

Figure 16:
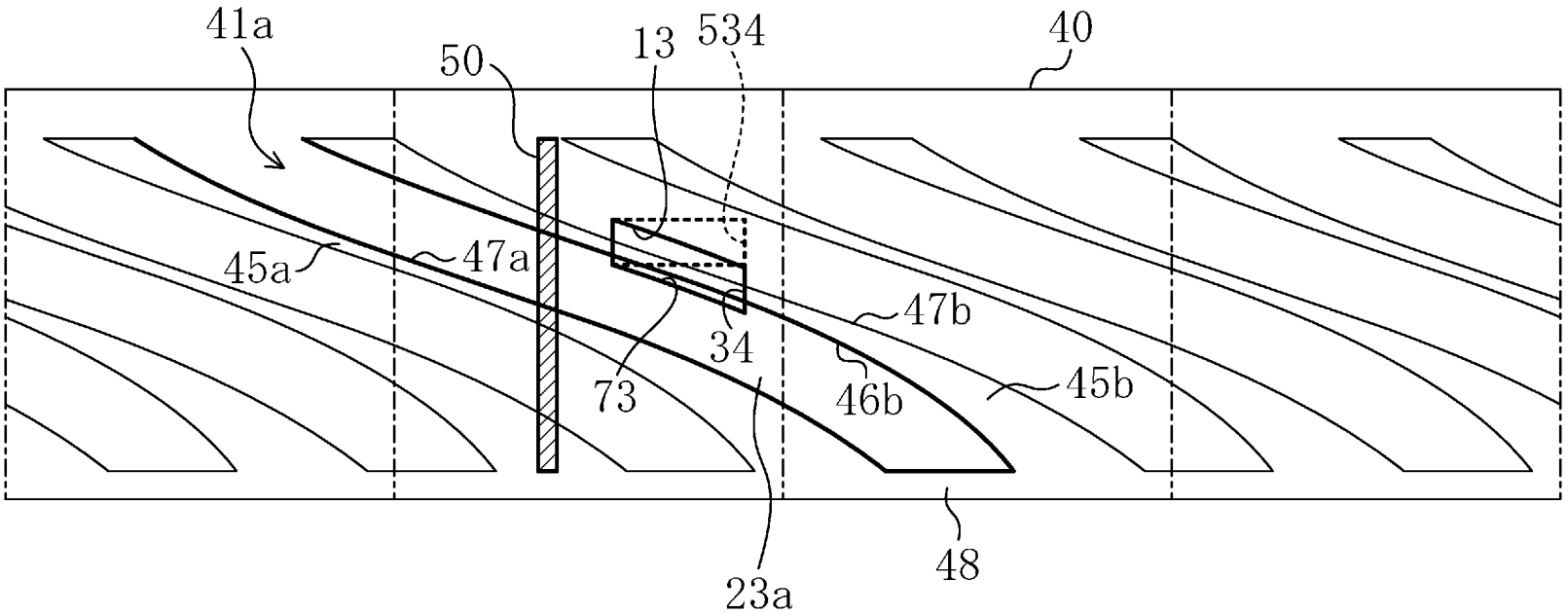
[FIG. 16]

As shown in FIG. 16, in this alternative, the screw-side edge (73) of the slide valve (70) is kept exposed to the fluid chamber (23*a*) until the fluid chamber (23*a*) is blocked from the bypass passage (33). Thus, in this alternative, the area of the opening (34) of the bypass passage (33) overlapping the helical groove (41*a*) (i.e., the actual bypass area) can be increased as much as possible even in a last part of the period in which the fluid chamber (23*a*) communicates with the bypass passage (33). This can reliably reduce the pressure loss which occurs when the refrigerant in the fluid chamber (23*a*) flows into the bypass passage (33), and can reliably reduce the power required to push the fluid in the fluid chamber (23*a*) into the bypass passage (33).

—Second Alternative of Embodiment—

Figure 17:
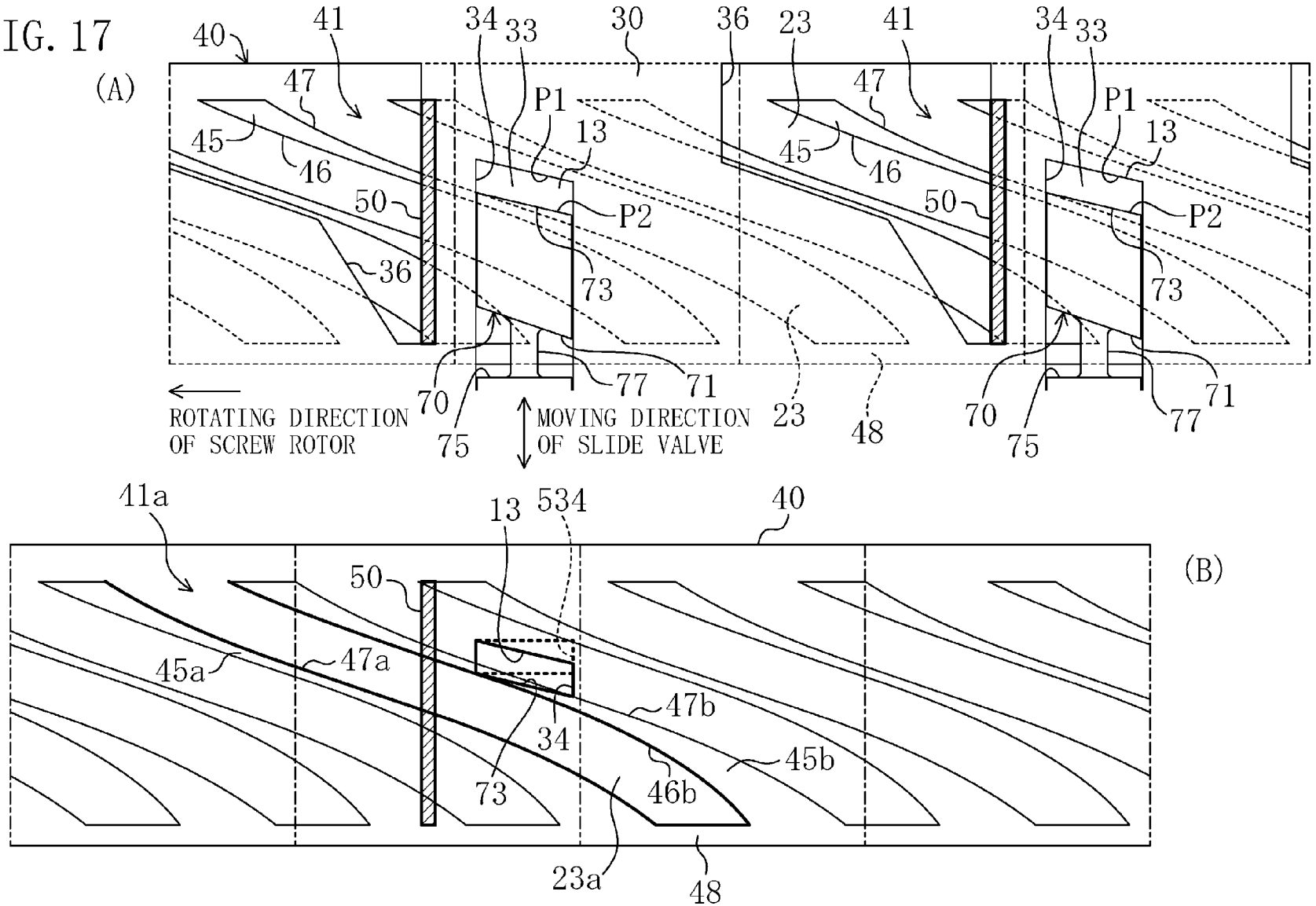
[FIG. 17]
Figure 18:
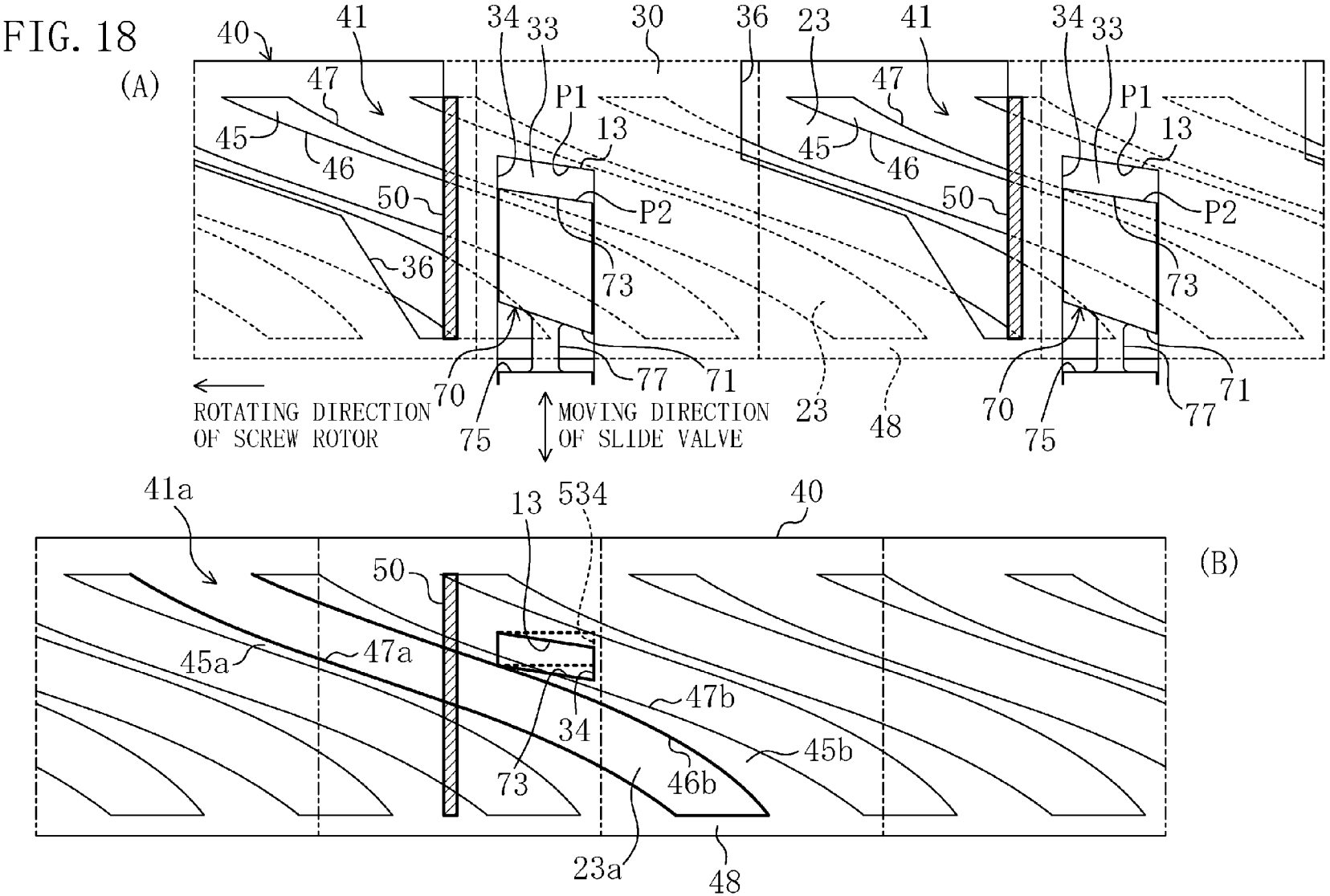
[FIG. 18]

As shown in FIGS. 17 and 18, the screw-side edge (73) of the slide valve (70) of the present embodiment may be shaped in such a manner that an angle formed by the extending direction thereof and the circumferential direction of the screw rotor (40) (i.e., the rotating direction of the screw rotor (40)) is slightly smaller than the angle shown in FIG. 7. In the examples shown in FIGS. 17 and 18, the screw-side edge (13) of the cylindrical wall (30) is parallel to the screw-side edge (73) of the slide valve (70).

Every part of the screw-side edge (73) of the slide valve (70) shown in FIG. 17 overlaps with the circumferential sealing face (45*b*) positioned backward of the helical groove (41*a*) when the helical groove (41*a*) is completely blocked from the bypass passage (33) as shown in FIG. 17(B). At this time, an end of the screw-side edge (73) of the slide valve (70) coincides with the front edge (46*b*) of the circumferential sealing face (45*b*), and the other end coincides with the back edge (47*b*) of the circumferential sealing face (45*b*).

The angle formed by the extending direction of the screw-side edge (73) of the slide valve (70) shown in FIG. 18 and the circumferential direction of the screw rotor (40) is much smaller than the angle shown in FIG. 17. The screw-side edge (73) of the slide valve (70) shown in FIG. 18 partially overlaps the circumferential sealing face (45*b*) positioned backward of the helical groove (41*a*) when the helical groove (41*a*) is completely blocked from the bypass passage (33) as shown in FIG. 18(B).

—Third Alternative of Embodiment—

Figure 19:
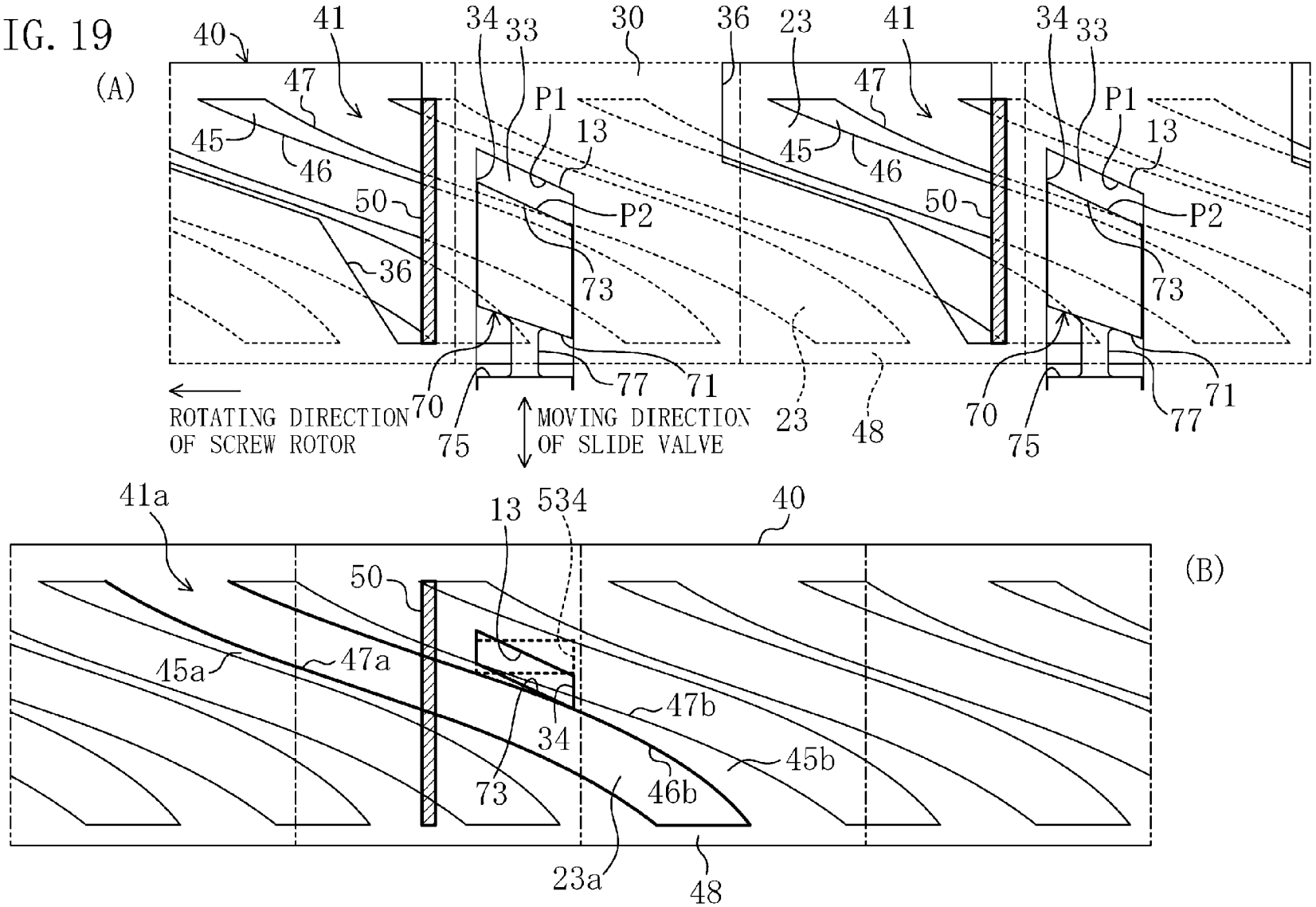
[FIG. 19]
Figure 20:
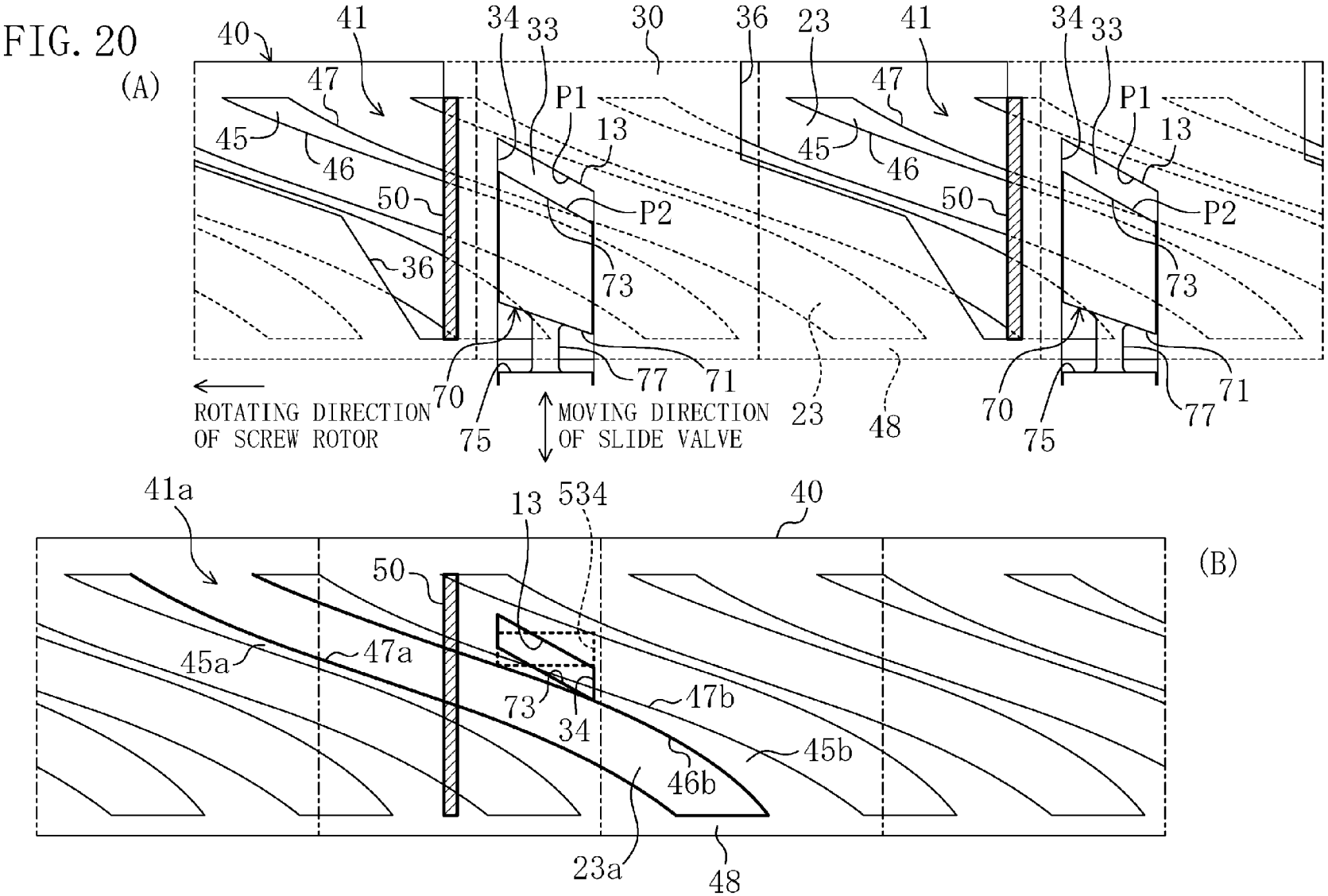
[FIG. 20]
Figure 21:
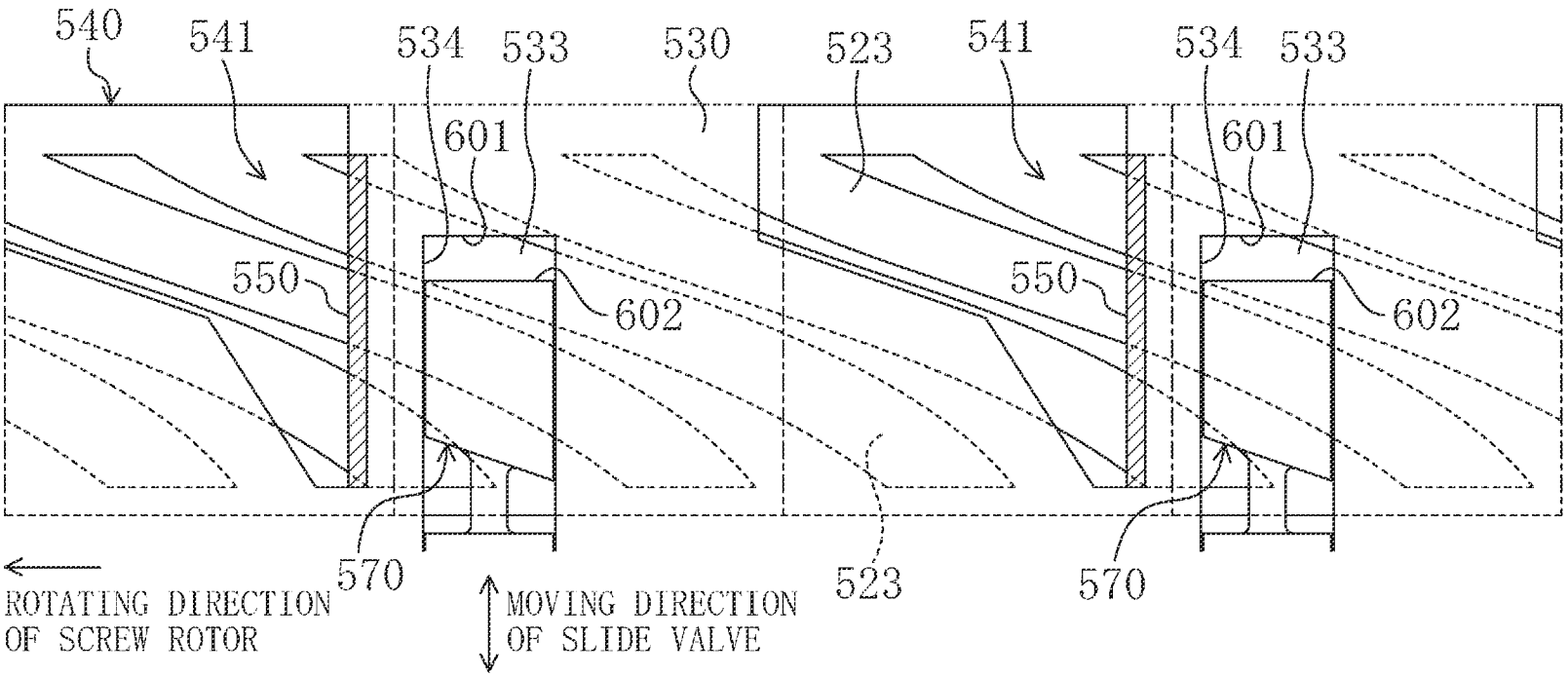
FIG. 21 PRIOR ART
[FIG. 21]
Figure 22:
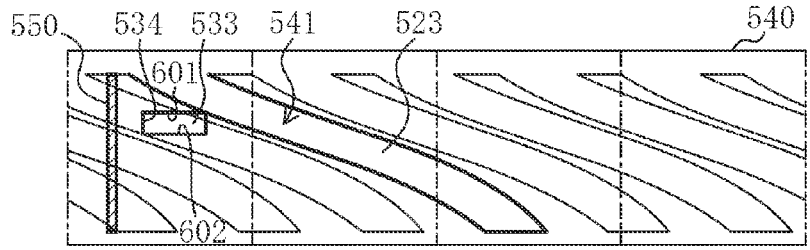
FIG. 22 PRIOR ART
[FIG. 22]
Figure 22:
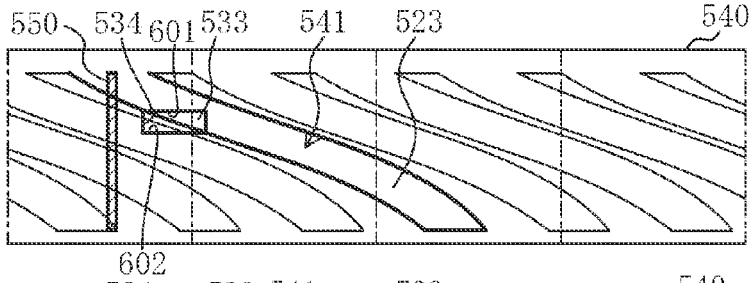
FIG. 22 PRIOR ART
Figure 22:
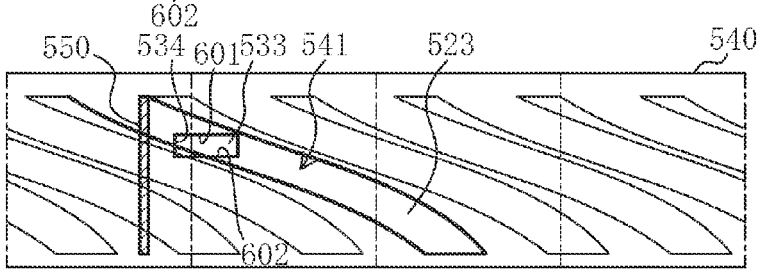
FIG. 22 PRIOR ART
Figure 22:
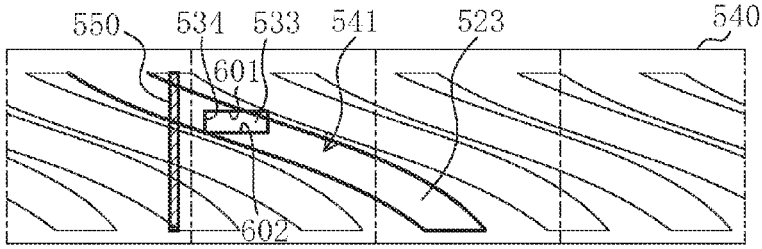
FIG. 22 PRIOR ART
Figure 22:
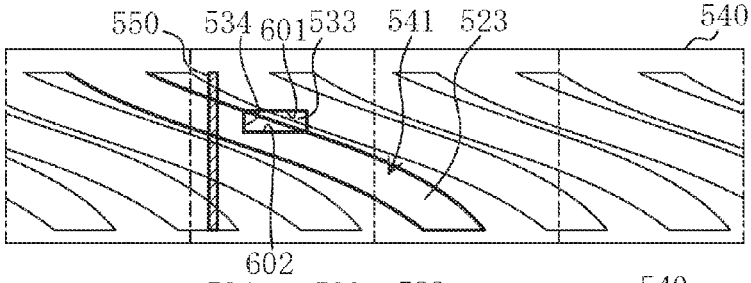
FIG. 22 PRIOR ART
Figure 22:
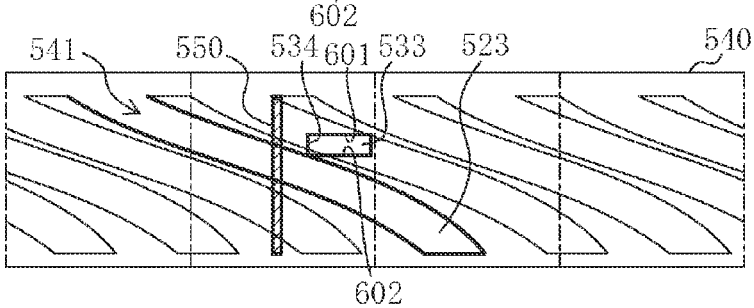
FIG. 22 PRIOR ART

As shown in FIGS. 19 and 20, the screw-side edge (73) of the slide valve (70) of the present embodiment may be shaped in such a manner that an angle formed by the extending direction thereof and the circumferential direction of the screw rotor (40) (i.e., the rotating direction of the screw rotor (40)) is slightly larger than the angle shown in FIG. 7. In the examples shown in FIGS. 19 and 20, the screw-side edge (13) of the cylindrical wall (30) is parallel to the screw-side edge (73) of the slide valve (70).

Every part of the screw-side edge (73) of the slide valve (70) shown in FIG. 19 overlaps the circumferential sealing face (45*b*) positioned backward of the helical groove (41*a*) when the helical groove (41*a*) is completely blocked from the bypass passage (33) as shown in FIG. 19(B). At this time, an end of the screw-side edge (73) of the slide valve (70) coincides with the back edge (47*b*) of the circumferential sealing face (45*b*), and the other end coincides with the front edge (46*b*) of the circumferential sealing face (45*b*).

The angle formed by the extending direction of the screw-side edge (73) of the slide valve (70) shown in FIG. 20 and the circumferential direction of the screw rotor (40) is much larger than the angle shown in FIG. 19. The screw-side edge (73) of the slide valve (70) shown in FIG. 20 partially overlaps with the circumferential sealing face (45*b*) positioned backward of the helical groove (41*a*) when the helical groove (41*a*) is completely blocked from the bypass passage (33) as shown in FIG. 20(B).

—Fourth Alternative of Embodiment—

In the above-described embodiment, the present invention is applied to the single screw compressor. However, the present invention may be applied to a twin screw compressor (a so-called Lysholm compressor).

The above-described embodiment has been set forth merely for the purposes of preferred examples in nature, and are not intended to limit the scope, applications, and use of the invention.

Industrial Applicability

As described above, the present invention is useful for screw compressors including a slide valve for controlling a capacity.

What is claimed is:

1. A screw compressor comprising:

a screw rotor provided with a plurality of helical grooves forming fluid chambers;

a casing including a cylinder portion with the screw rotor disposed therein;

a low pressure space formed in the casing to receive a flow of uncompressed, low pressure fluid;

a bypass passage opened in an inner peripheral surface of the cylinder portion to communicate the fluid chamber with the low pressure space; and a slide valve slideable in an axial direction of the screw rotor to change an area of an opening of the bypass passage in the inner peripheral surface of the cylinder portion, an end face of the slide valve facing the bypass passage being inclined along an extending direction of the helical grooves, part of an outer peripheral surface of the screw rotor sandwiched between two adjacent helical grooves forming a circumferential sealing face slideable on the inner peripheral surface of the cylinder portion to seal between the two adjacent helical grooves, an edge of the circumferential sealing face positioned forward in a direction of rotation of the screw rotor forming a front edge of the circumferential sealing face, an edge of the end face of the slide valve adjacent to the screw rotor forming a screw-side edge, and the screw-side edge of the slide valve being parallel to the front edge of the circumferential sealing face of the screw rotor.

2. The screw compressor of claim 1, further comprising:

a gate rotor including a plurality of radially arranged gates meshing the helical. grooves of the screw rotor, an opening of the bypass passage formed in the inner peripheral surface of the cylinder portion being fully opened in the fluid chamber divided from the low pressure space by the gate in a period in which the screw rotor is rotated by a predetermined angle.

3. A screw compressor comprising:

a screw rotor provided with a plurality of helical grooves forming fluid chambers;

a casing including a cylinder portion with the screw rotor disposed therein;

a gate rotor including a plurality of radially arranged gates meshing with the helical grooves of the screw rotor;

a low pressure space formed in the casing to receive a flow of uncompressed, low pressure fluid;

a bypass passage opened in an inner peripheral surface of the cylinder portion to communicate the fluid chamber with the low pressure space; and a slide valve slideable in an axial direction of the screw rotor to change an area of an opening of the bypass passage in the inner peripheral surface of the cylinder portion, an end face of the slide valve facing the bypass passage being inclined along an extending direction of the helical grooves, and an opening of the bypass passage formed in the inner peripheral surface of the cylinder portion being fully opened in the fluid chamber divided from the low pressure space by the gate in a period in which the screw rotor is rotated by a predetermined angle.

4. A screw compressor comprising:

a screw rotor provided with a plurality of helical grooves forming fluid chambers;

a casing including a cylinder portion with the screw rotor disposed therein;

a gate rotor including a plurality of radially arranged gates meshing with the helical grooves of the screw rotor;

a low pressure space formed in the casing to receive a flow of uncompressed, low pressure fluid;

a bypass passage opened in an inner peripheral surface of the cylinder portion to communicate the fluid chamber with the low pressure space; and a slide valve slideable in an axial direction of the screw rotor to change an area of an opening of the bypass passage in the inner peripheral surface of the cylinder portion, an end face of the slide valve facing the bypass passage being inclined along an extending direction of the helical grooves, part of an outer peripheral surface of the screw rotor sandwiched between two adjacent helical grooves forming a circumferential sealing face slideable on the inner peripheral surface of the cylinder portion to seal between the two adjacent helical grooves, an edge of the end face of the slide valve adjacent to the screw rotor forming a screw-side edge, the screw-side edge of the slide valve being shaped such that every part thereof simultaneously overlaps the circumferential sealing face, and an opening of the bypass passage formed in the inner peripheral surface of the cylinder portion being fully opened in the fluid chamber divided from the low pressure space by the gate in a period in which the screw rotor is rotated by a predetermined angle.

* * * * *